US010501968B2

(12) United States Patent
Maher et al.

(10) Patent No.: US 10,501,968 B2
(45) Date of Patent: Dec. 10, 2019

(54) DOOR HOLDING DEVICE AND SAFETY SYSTEM

(71) Applicants: Robert Michael Maher, Columbus, OH (US); Christopher J. Caito, Galena, OH (US)

(72) Inventors: Robert Michael Maher, Columbus, OH (US); Christopher J. Caito, Galena, OH (US)

( * ) Notice: Subject to any disclaimer, the term of this patent is extended or adjusted under 35 U.S.C. 154(b) by 430 days.

(21) Appl. No.: 15/411,766

(22) Filed: Jan. 20, 2017

(65) Prior Publication Data

US 2017/0204641 A1 Jul. 20, 2017

Related U.S. Application Data

(60) Provisional application No. 62/281,154, filed on Jan. 20, 2016.

(51) Int. Cl.
*E05C 17/04* (2006.01)
*E05C 19/18* (2006.01)
(Continued)

(52) U.S. Cl.
CPC ..... *E05C 17/047* (2013.01); *E05C 17/08* (2013.01); *E05C 17/30* (2013.01); *E05C 17/54* (2013.01);
(Continued)

(58) Field of Classification Search
CPC . Y10T 292/34; Y10T 292/37; Y10T 292/373; Y10T 292/376; Y10T 292/379; Y10T 292/382; Y10T 292/385; Y10T 292/388; Y10T 292/391; Y10T 292/394; Y10T 292/397; Y10T 292/65; Y10T 292/67; Y10T 292/262; Y10T 292/265; Y10T 292/266; Y10T 292/267; Y10T 292/268; Y10T 292/269; Y10T 292/27;
(Continued)

(56) References Cited

U.S. PATENT DOCUMENTS 236,531 A * 1/1881 Barton ..... E05C 19/18 292/206
710,118 A * 9/1902 Prud'homme ..... E05C 19/182 292/294
(Continued)

FOREIGN PATENT DOCUMENTS

DE 10241264 A1 * 7/2004 ..... E05C 17/34
FR 2968341 A1 * 6/2012 ..... E05C 17/047

OTHER PUBLICATIONS

Computer Generated Translation for FR 2968341 A1, Generated on May 21, 2019, https://worldwide.espacenet.com/ (Year: 2019).*
(Continued)

*Primary Examiner* — Alyson M Merlino
(74) *Attorney, Agent, or Firm* — Walter Haverfield LLP; James J. Pingor

(57) ABSTRACT

A door holding device and system is disclosed that holds a door in a partially open configuration. The door holding device includes a first arm assembly that attaches to a door frame, a second arm assembly that attaches to a door, a movable clamping mechanism that clamps the first arm assembly to the door frame, and a pivot device that allows the first arm assembly and the second arm assembly pivot with respect to each other.

16 Claims, 26 Drawing Sheets

(51) Int. Cl.

| | |
|---|---|
| ***E05C 17/08*** | (2006.01) |
| ***E05C 17/30*** | (2006.01) |
| ***E05C 17/54*** | (2006.01) |
| *A62C 99/00* | (2010.01) |
| *E05C 17/32* | (2006.01) |
| *A62C 33/06* | (2006.01) |

(52) U.S. Cl.
CPC ..... *E05C 19/182* (2013.01); *A62C 33/06* (2013.01); *A62C 99/009* (2013.01); *E05C 17/32* (2013.01)

(58) Field of Classification Search
CPC ..... Y10T 292/276; Y10T 292/277; Y10T 292/278; Y10T 70/40; Y10T 70/5164; E05C 17/047; E05C 17/08; E05C 17/30; E05C 17/54; E05C 17/32; E05C 17/00; E05C 17/04; E05C 17/045; E05C 17/34; E05C 17/345; E05C 17/46; E05C 17/48; E05C 19/003; E05C 19/005; E05C 19/18; E05C 19/182; E05C 19/184; E05C 19/188; Y10S 292/15; Y10S 292/65
See application file for complete search history.

(56) References Cited

U.S. PATENT DOCUMENTS

| | | | | |
|---|---|---|---|---|
| 1,687,517 | A * | 10/1928 | Sasgen | E05C 17/443 292/238 |
| 2,505,320 | A | 4/1950 | Bernhard | |
| 2,744,779 | A | 5/1956 | Ellis | |
| 2,774,622 | A | 12/1956 | Priebe | |
| 2,808,608 | A | 10/1957 | O'Hare | |
| 2,924,479 | A * | 2/1960 | Butler | E05C 19/182 292/296 |
| 4,653,140 | A | 3/1987 | Hudec et al. | |
| 5,216,418 | A | 6/1993 | Lenz et al. | |
| 5,592,780 | A | 1/1997 | Checkovich | |
| 6,873,256 | B2 | 3/2005 | Lemelson et al. | |
| 9,816,295 | B1 * | 11/2017 | Taylor | E05C 19/188 |
| 2016/0237725 | A1 * | 8/2016 | Raffi | E05C 7/04 |
| 2019/0112850 | A1 * | 4/2019 | D'Souza | E05C 17/047 |

OTHER PUBLICATIONS

International Search Report and Written Opinion for International Patent Application No. PCT/US17/14403 dated May 18, 2017, 18 pages.

* cited by examiner

SECTION A - A

SECTION A - A

DETAIL A

DOOR HOLDING DEVICE AND SAFETY SYSTEM

CROSS-REFERENCE TO RELATED APPLICATIONS

This application claims the benefit of U.S. Provisional Patent Application Ser. No. 62/281,154 entitled "Door Holding Device, Particularly For Use By Firefighters and Other Emergency Response Personnel" filed on Jan. 20, 2016 of which the entirety of the above-noted application is incorporated by reference herein.

ORIGIN

The invention generally relates to a door holding device. More particularly, the invention relates to a door holding device that is configured to fix a door of a building structure in a predetermined position while firefighting operations are taking place in the building structure.

BACKGROUND

Studies conducted by Underwriters Laboratories (UL), National Institute of Standards and Technology (NIST), and The Bureau of Alcohol, Tobacco, Firearms and Explosives (ATF) Fire Research Laboratory have concluded that ventilation flow paths within a structure fire are directly attributed to the spread of fire, and the loss of lives and property. The above studies proved that controlling the amount of opening of the door (i.e. door control) used by firefighters is the valve for limiting flow path. Flow path is the volume between an inlet and an outlet that allows the movement of heat and smoke from higher pressure within the fire area toward the lower pressure areas accessible via door and window openings. Firefighting operations conducted in the flow path, between the fire and where the fire wants to go, will place civilians and firefighters at significant risk due to the increase flow of fire, heat and smoke toward their position. Fire, heat and smoke also can cause structural members to fail or windows to shatter causing rapid changes in flow path within a structure. These rapid changes may necessitate the emergent evacuation of firefighting personnel.

Door control has been identified as the most important component in restricting the flow of air into a building that is on fire. Lack of flow path control, by either intentional or unintentional ventilation of a building on fire has been proven to accelerate progression of the fire. This resulting rapid fire progression has resulted in civilian and firefighter injuries and deaths. Most fire departments do not have enough manpower on a scene to allow dedication of a member to stay at the entry door keeping it closed as much as possible while crews operate inside the building with a fire hose line.

The conventional means for controlling exterior and interior doors is a wooden or plastic triangular wedge. These tools have been used in the fire service for decades, but offer little to no assurance that they will fix a door in place while resisting force from all directions that occur during firefighting operations, such as advancing a fire hose line into and throughout the structure. Most importantly, the conventional wedge in no way offers a means for efficient and rapid removal thereof during emergency egress by firefighters.

SUMMARY

The following presents a simplified summary in order to provide a basic understanding of some aspects of the innovation. This summary is not an extensive overview of the innovation. It is not intended to identify key/critical elements or to delineate the scope of the innovation. Its sole purpose is to present some concepts of the innovation in a simplified form as a prelude to the more detailed description that is presented later.

In an aspect of the innovation a door holding device is disclosed that includes a first arm assembly, a second arm assembly, a pivot device that pivotally connects the first arm assembly to the second arm assembly, and a movable clamping mechanism slidably attached to the second arm assembly that clamps to a structure to secure the door holding device to the structure.

In another aspect of the innovation a door holding system is disclosed that includes a door holding device including a movable clamping mechanism slidably that clamps to a structure to secure the door holding device to the structure, and an electronic wireless communicator disposed in the door holding device, wherein the wireless communicator provides electronic communication to and/or from an external electronic communicating system.

In still another aspect of the innovation a method of securing a door in a partially open configuration is disclosed that includes providing a door holding device having a first arm assembly, a second arm assembly, and a movable clamping mechanism, placing the first arm assembly against a door frame whereby a longitudinal part contacts an end face of the door frame and a stationary part contacts one side of the door frame, moving the movable clamping mechanism along the longitudinal part toward the door frame, contacting an opposite side of the door frame with a movable pad on the movable clamping mechanism, tightening the movable pad against the opposite side of the door frame, compressing the movable pad against the opposite side of the door frame, compressing a stationary pad against the one side of the door frame, and placing a vertical end of the door into the a U-shaped holder.

The following description and drawings set forth certain illustrative aspects and implementations. These are indicative of but a few of the various ways in which one or more aspects may be employed. Other aspects, advantages, or novel features of the disclosure will become apparent from the following detailed description when considered in conjunction with the drawings.

BRIEF DESCRIPTION OF THE DRAWINGS

The accompanying drawings, which are incorporated in and constitute a part of the specification, illustrate various systems, methods, and other embodiments of the disclosure. Illustrated element boundaries (e.g., boxes, groups of boxes, or other shapes) in the figures represent one example of the boundaries. In some examples one element may be designed as multiple elements or multiple elements may be designed as one element. In some examples, an element shown as an internal component of another element may be implemented as an external component and vice versa.

DETAILED DESCRIPTION

Figure 1:
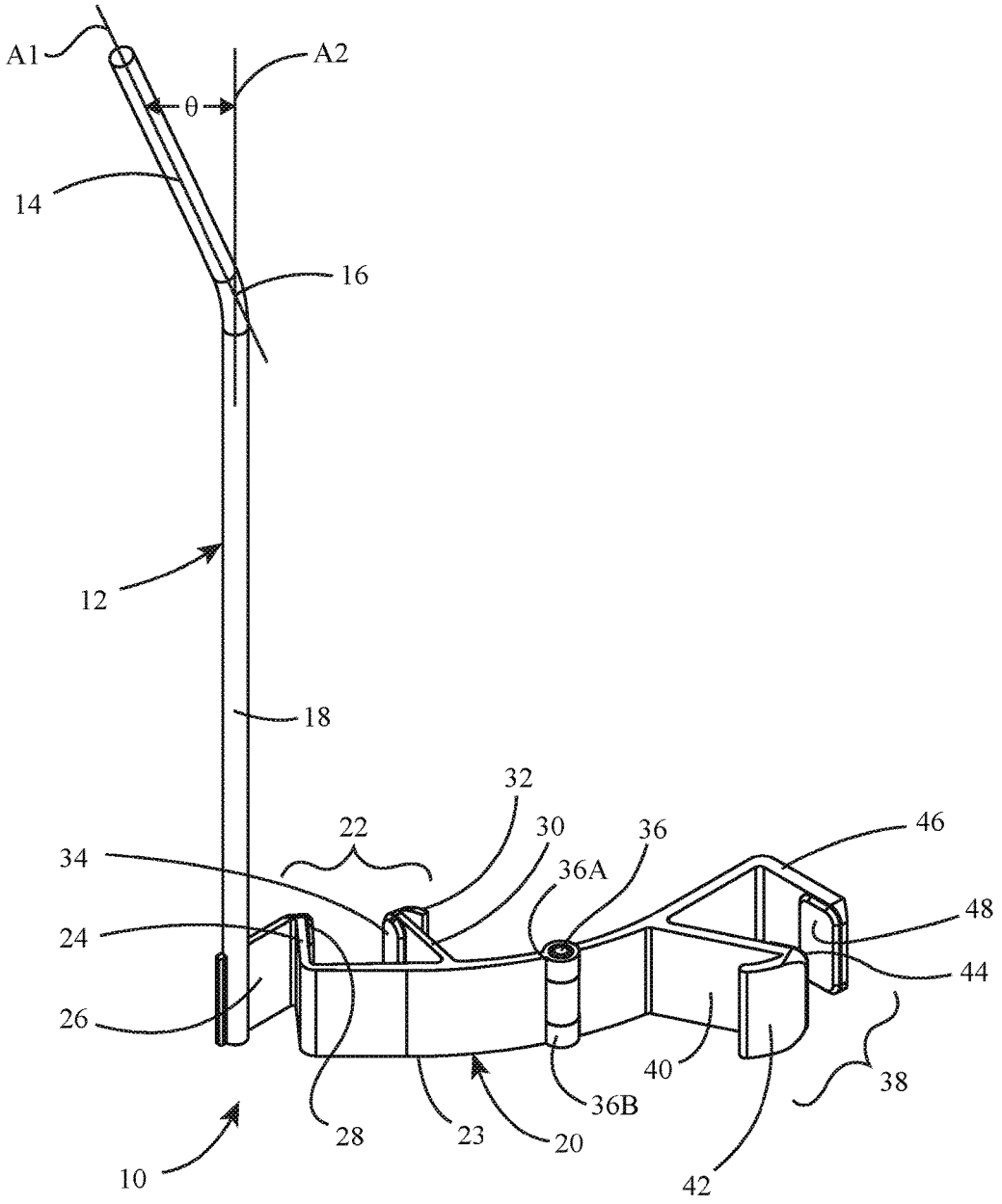
FIGS. 1 and 2 are perspective views of one example embodiment of a door holding device in accordance with an aspect of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details. In other instances, well-known structures and devices are shown in block diagram form in order to facilitate describing the innovation.

While specific characteristics are described herein (e.g., thickness, orientation, configuration, etc.), it is to be understood that the features, functions and benefits of the innovation can employ characteristics that vary from those described herein. These alternatives are to be included within the scope of the innovation and claims appended hereto.

While, for purposes of simplicity of explanation, the one or more methodologies shown herein, e.g., in the form of a flow chart, are shown and described as a series of acts, it is to be understood and appreciated that the subject innovation is not limited by the order of acts, as some acts may, in accordance with the innovation, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation.

Disclosed herein is an innovative door holding device that overcomes the aforementioned disadvantages. Studies performed at UL found that while fighting a fire, allowing a door to remain partially open approximately 18 inches is an optimal gap or opening in order to allow the movement of fire hoses into the structure while simultaneously controlling the flow path defined above. The innovative door holding device disclosed herein is capable of securely fixing a door in place, while resisting forces that commonly occur during firefighting operations, such as those forces created by the advancing of the fire hose. Furthermore, the innovative door holding device effectively restricts the amount of airflow through a door opening, and therefore controls flow path, while aiding in the restriction of fire growth.

In addition, the innovative door holding device allows firefighters to view smoke emitting from the doorway where the door holding device is applied, which allows the firefighters to observe changes in fire conditions throughout the emergency. Observation of changes in fire conditions is a very large variable in tactical decision making.

The innovative door holding device, however, includes adjustable features that allows firefighters to adjust the door opening greater or less than 18 inches or where in instances where the fire is mostly extinguished. In these instances, firefighters are investigating void spaces in the structure where fire can hide and ultimately cause the fire to begin again if left undetected. Because the flow path of air into the structure can reach these void spaces and there may be no need to advance the fire hose further, firefighters may want to adjust the door opening in an even more closed position to restrict the movement of air that much more in order to protect themselves and the structure.

Figure 2:
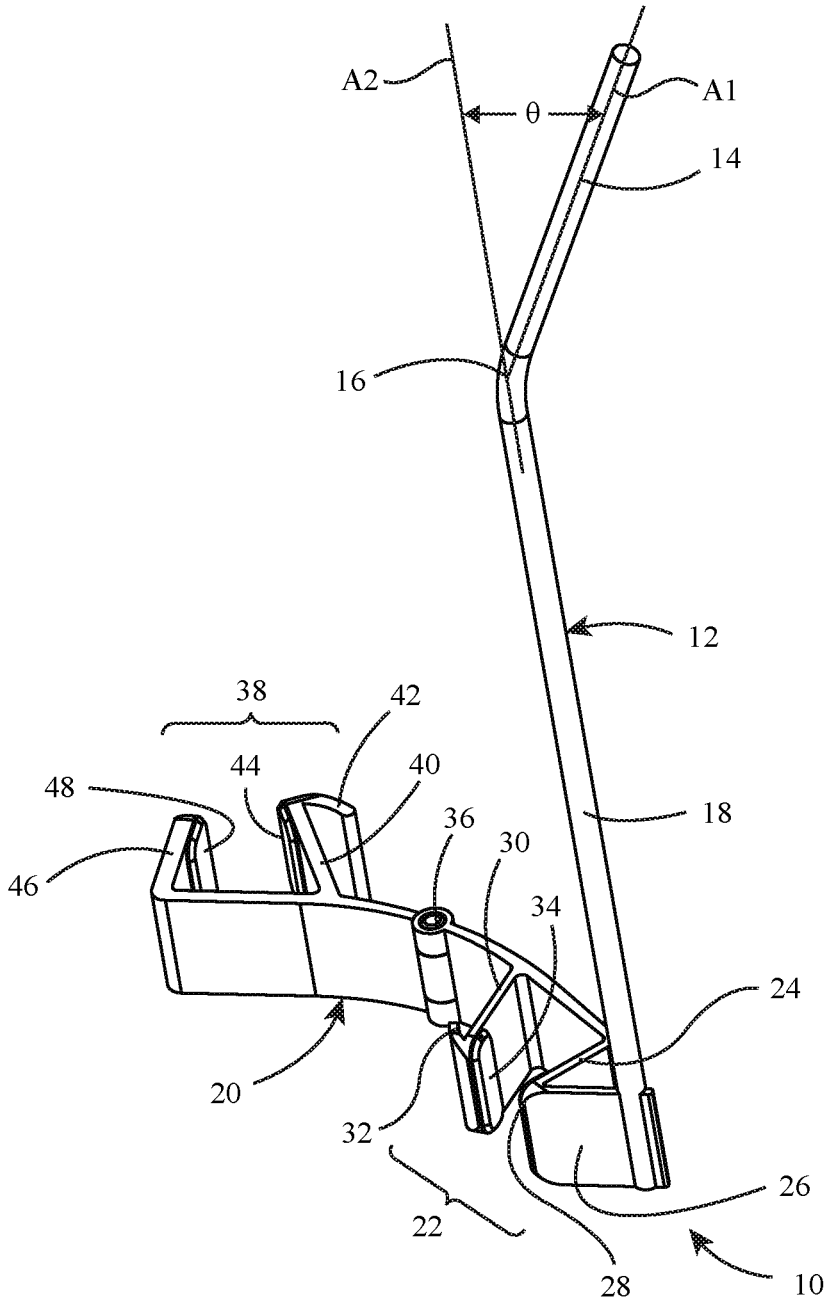
Figure 3:
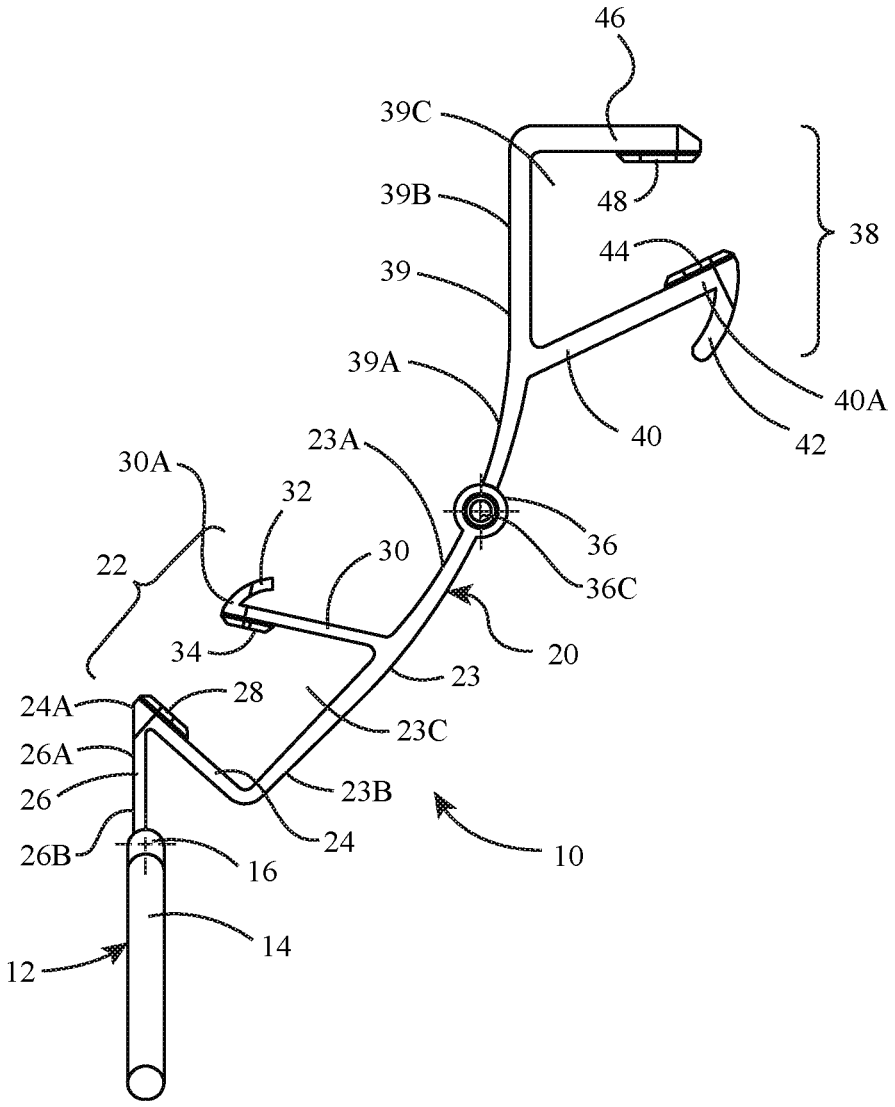
FIG. 3 is a top plan view of the door holding device of FIG. 1 in accordance with an aspect of the innovation.
Figure 4:
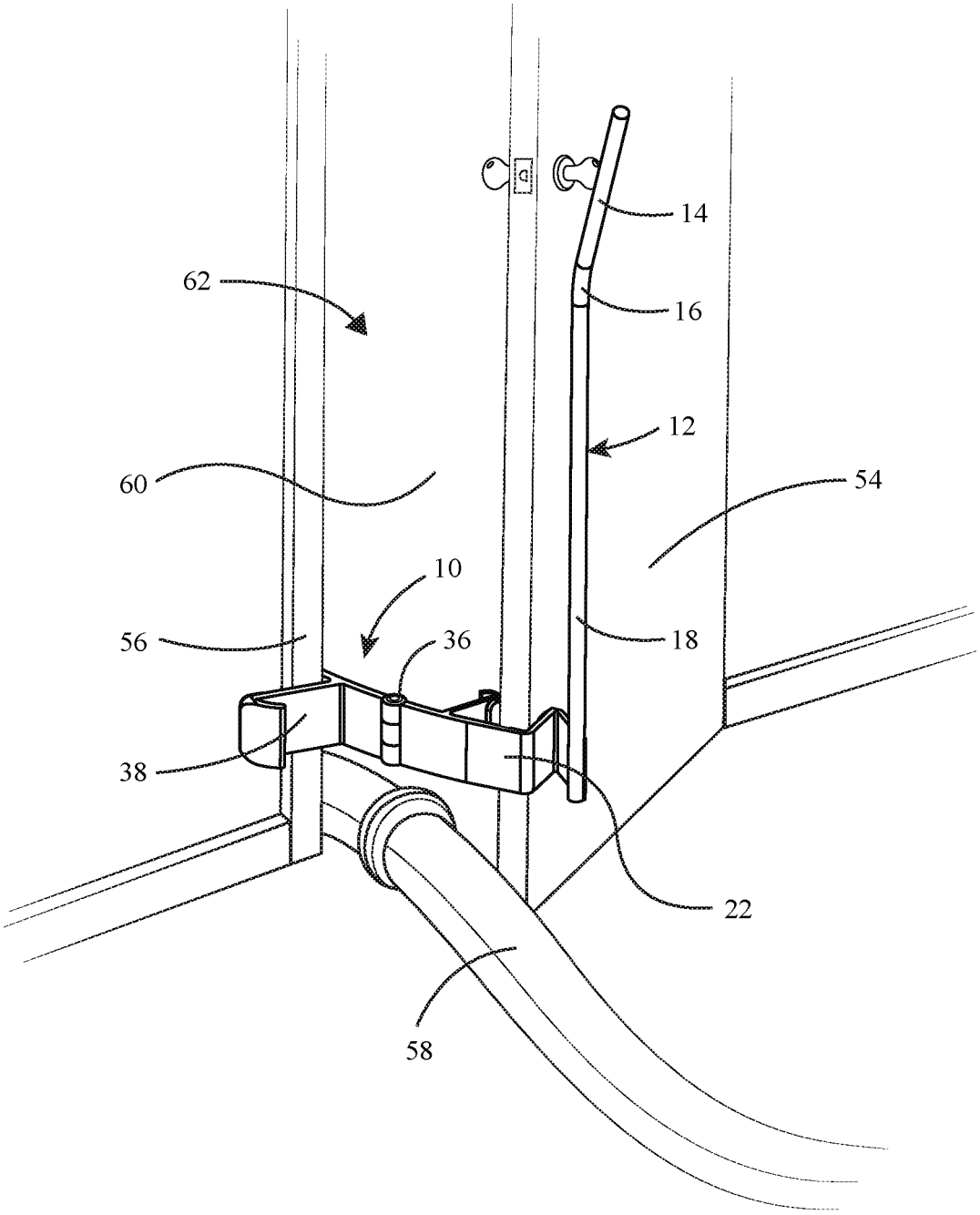
FIG. 4 is a perspective view illustrating the door holding device of FIG. 1 being used to hold a door in a mostly closed position in accordance with an aspect of the innovation.

Referring now to the drawings, FIGS. 1 and 2 are perspective views of an innovative door holding device 10, FIG. 3 is a top view of the innovative door holding device 10, and FIG. 4 is an illustration of a door structure that includes a door 54, a door frame 56, and a door opening 60 in accordance with an aspect of the innovation. The innovative door holding device 10 holds the door 54 in a partially open (or partially closed) position when firefighters are in the process of any or all firefighting procedures. In other words, the door holding device 10 secures the door 54 in a position that is open enough to allow firefighters to run fire hoses through a gap 62 in the door opening 60, but closed enough to restrict the flow of air/ventilation through the door opening 60.

The door holding device 10 includes a body assembly 20 and a handle (quick-release) mechanism 12 that connects to the body portion 20. As will be described further below, the handle mechanism 12 facilitates a quick disengagement of the door holding device 10 from the door structure.

The body assembly 20 includes a first clamp device 22, a second clamp device 38, and a pivoting mechanism 36 (e.g., a hinge) pivotally connecting the first clamp device 22 and the second clamp device 38 to each other. The first clamp device 22 is configured to attach to a structure (e.g., door, door frame, etc.) and includes a first arm 23 and a first clamp comprising a first clamp member 24 and a second clamp member 30. The first arm 23 includes a proximate end 23A having a first pivot portion 36A attached thereto, and a distal end 23B. The first and second clamp members 24, 30 are spaced apart and extend from the distal end 23B of the first arm 23 to thereby form a general U-shape with the distal end 23B of the first arm 23. Thus, the first and second clamp members 24, 30 are disposed on opposite sides of the structure and the structure is disposed in a space 23C defined between the first and second clamp members 24, 30 when the door holding device 10 is in use.

The first clamp member 24 includes a first clamp pad portion 28 disposed on an inside surface thereof and the second clamp member 30 includes a second clamp pad portion 34 disposed on an inside surface thereof. When the door holding device 10 is in use, the first clamp pad portion 28 is disposed against a surface (first surface) of the structure and the second clamp pad portion 34 is disposed against a generally opposite (second) surface of the structure. In one or more embodiments, the clamp pad portions 28, 34 may be formed from a compressible resilient material (e.g., a compressible rubber material) for enhancing the surface contact friction between the first and second clamp members 24, 30 of the first clamp device 22 and the opposed surfaces of the structure. Forming the clamp pad portions 28, 34 from a compressible resilient material also helps to protect the structure surfaces from being scratched or marred by the clamp members 24, 30 of the first clamp device 22.

The first clamp member 24 further includes a first flange 26 that extends from a distal end 24A of the first clamp member 24 in a direction away from the second clamp member 30. Similarly, the second clamp member 30 further includes a second flange 32 that extends from a distal end 30A of the second clamp member 30 in a direction away from the first clamp member 24. The first and second flanges 26, 32 facilitate a disengagement of the first clamp device 22 from the structure by a user. More specifically, when the user grasps and pulls on either the first or second flange, its respective clamp member 24, 30 is deformed outwardly away from the surface of the structure, and the first clamp device 22 is disengaged from the structure. Thus, the first and second flanges 26, 32 function as release mechanisms so as to allow the user to easily disengage the first clamp device 22 from the structure. In addition, the first flange 26 of the first clamp member 24 also provides a connection between the handle mechanism 12 and the body assembly 20. Specifically, the first flange 26 includes a proximate end 26A that connects to the distal end 24A of the first clamp member 24 and a distal end 26B that connects to the handle mechanism 12 described further below.

The body assembly 20 of the door holding device 10 may be formed from a resilient material (e.g., a resilient plastic or metal) so that the first and second spaced-apart clamp members 24, 30 of the first clamp device 22 are capable of being resiliently deformed when they are engaged with the structure. As such, the first clamp device 22 of the door holding device 10 is capable of securely grasping the portion of the structure when its prong-like clamp members 24, 30 are deformed (i.e., the clamp members 24, 30 grasp the cross-section of the structure in a friction-fit type engagement). Alternatively, the first arm 23 may be formed from a rigid material and the first and second clamp members 24, 30 may formed from a resilient material or vice versa.

The second clamp device 38 is configured to attach to a structure (e.g., door, door frame, etc.) and includes a second arm 39 and a second clamp comprising a third clamp member 40 and a fourth clamp member 46. The second arm 39 includes a proximate end 39A having a second pivot portion 36B attached thereto, and a distal end 39B. The third and fourth clamp members 40, 46 are spaced apart and extend from the distal end 39B of the second arm 39 to thereby form a general U-shape with the distal end 39B of the second arm 39. Thus, the third and fourth clamp members 40, 46 are disposed on opposite sides of the structure and the structure is disposed in a space 39C defined between the third and fourth clamp members 40, 46 when the door holding device 10 is in use.

The third clamp member 40 includes a third clamp pad portion 44 disposed on an inside surface thereof and the fourth clamp member 46 includes a fourth clamp pad portion 48 disposed on an inside surface thereof. When the door holding device 10 is in use, the third clamp pad portion 44 is disposed against a surface (first surface) of the structure and the fourth clamp pad portion 48 is disposed against a generally opposite (second) surface of the structure. In one or more embodiments, the clamp pad portions 44, 48 may be formed from a compressible resilient material (e.g., a compressible rubber material) for enhancing the surface contact friction between the third and fourth clamp members 44, 48 of the second clamp device 38 and the opposed surfaces of the structure. Forming the clamp pad portions 44, 48 from a compressible resilient material also helps to protect the structure surfaces from being scratched or marred by the clamp members 40, 48 of the second clamp device 38.

The third clamp member 40 further includes a third flange 42 that extends from a distal end 40A of the third clamp member 40 in a direction away from the fourth clamp member 46. The third flange 42 facilitates a disengagement of the second clamp device 38 from the structure by the user. More specifically, when the user grasps and pulls on the third flange 42, the third clamp member 40 is deformed outwardly away from the surface of the structure, and the second clamp device 38 is disengaged from the structure. Thus, the third flange 42 functions as a release mechanism so as to allow the user to easily disengage the second clamp device 38 from the structure.

As described above the body assembly 20 of the door holding device 10 may be formed from a resilient material (e.g., a resilient plastic or metal) so that the third and fourth spaced-apart clamp members 40, 46 of the second clamp device 22 are capable of being resiliently deformed when they are engaged with the structure. As such, the second clamp device 38 of the door holding device 10 is capable of securely grasping the portion of the structure when its prong-like clamp members 40, 46 are deformed (i.e., the third and fourth clamp members 40, 46 grasp the cross-section of the structure in a friction-fit type engagement).

Alternatively, the second arm 39 may be formed from a rigid material and the third and fourth clamp members 40, 46 may formed from a resilient material or vice versa.

Still referring to FIGS. 1-3, the pivoting mechanism 36 provides a pivoting connection between the first clamp device 22 and the second clamp device 38 to enable the door holding device 10 to be adjusted for different door configurations. In the example embodiment described herein and illustrated in the figures, the pivoting mechanism 36 is comprised of the first pivot portion 36A and the second pivot portion 36B mentioned above, and a rod 36C (e.g., hinge pin). It is to be understood, however, that the pivoting mechanism 36 can be any type of pivoting mechanism that allows the first pivot portion 36A and the second pivot portion 36B pivot with respect to each other, such as but not limited to, a ball and socket type device, a fulcrum type device, etc.

As mentioned above, the first pivot portion 36A is disposed at a proximate end 23A of the first arm 23. In the example embodiment disclosed herein, the first pivot portion 36A has a circular shape and essentially makes up half of the pivot mechanism 36. Similarly, the second pivot portion 36B is disposed at a proximate end 39A of the second arm 39. In the example embodiment disclosed herein, the second pivot portion 36B has a circular shape and essentially makes up the other half of the pivot mechanism 36. The first pivot portion 36A and the second pivot portion 36B are offset from each other such that when they are joined, they form a hinge having an elongated aperture defined therein. The rod 36C is then inserted through the elongated aperture formed by the joining of the first and second pivot portions 36A, 36B thereby pivotally securing the first clamp device 22 with the second clamp device 38.

In one or more embodiments, the pivot mechanism 36 allows the opening gap 60 between the door 54 and the door frame 56 to be adjusted by a user so that the door holding device 10 may be readily adapted to different applications (i.e., the pivot mechanism 36 allows the door holding device 10 to be easily adjustable so as to accommodate objects of varying size passing through the door opening gap 60). In addition, in one or more embodiments, the pivot mechanism 36 enables a person disposed on the side of the door holding device 10, which is opposite to the quick-release mechanism 12, to "punch out" the device 10 and "break" the pivot mechanism 36 (e.g., a firefighter trying to make a quick emergency exit from the building structure with fire and heat at his or her back). In these one or more embodiments, when the pivot mechanism 36 collapses, the door 54 is able to freely swing open because the door holding device 10 will no longer be holding the door 54 in the mostly closed position. In addition, the pivot mechanism 36 allows the door holding device 10 to be folded for easy transport, storage, and can be mated with other firefighting tools.

Referring to FIGS. 1-3, the handle mechanism 12 is configured to be grasped by the user so as to allow the user to quickly and easily (quick release) disengage the door holding device 10 and permit a rapid opening of the door 54. The handle mechanism 12 includes an angled rod member with a bent rod portion 14 that is connected to a generally straight rod portion 18 by an elbow portion 16. In the illustrated embodiment, the bent rod portion 14 is oriented at an acute angle θ relative to the generally straight rod portion 18 (i.e., a longitudinal axis A1 of the bent rod portion 14 is disposed at an acute angle θ relative to a longitudinal axis A2 of the generally straight rod portion 18). Advantageously, the elongate geometry and the large size of the angled rod member makes the quick-release mechanism 12 easier for a user to find in an environment with little visibility (i.e., in a smoke-filled building that is being traversed by a firefighting crew).

Figure 5:
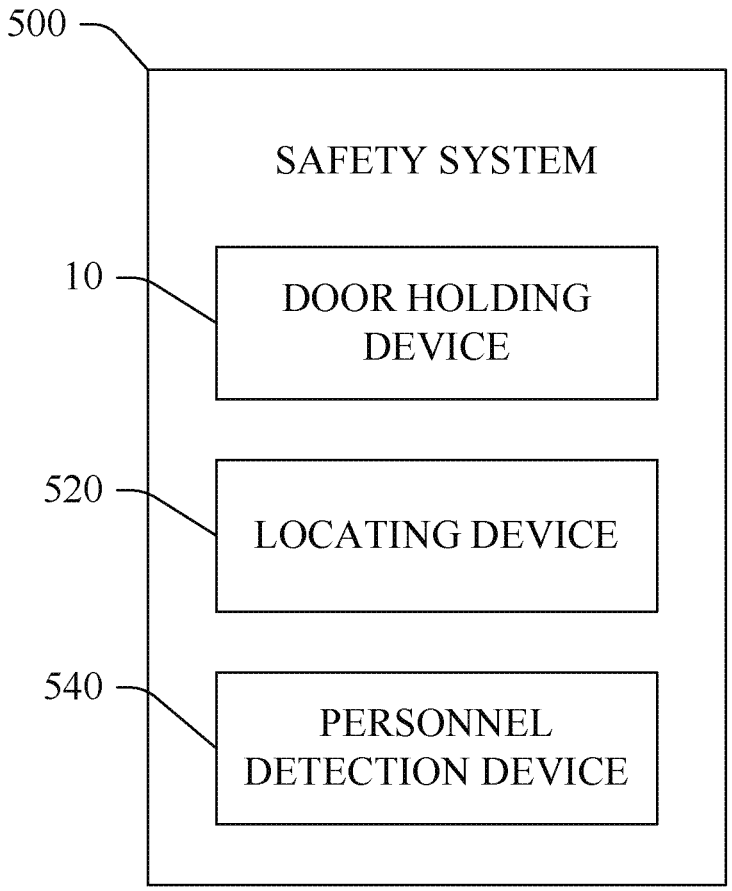
FIG. 5 is a block diagram illustration of a safety system that incorporates the innovative door holding device in accordance with an aspect of the innovation.

Referring to FIG. 5, in an alternate embodiment, the door holding device 10 may be part of a wireless communication safety system 500 that includes the innovative door holding device 10, a locating device 520, and a personnel detection device 540. The locating device 520 enables the user to locate the door holding device 10 within a building structure (e.g., the locating device 520 enables a firefighter fighting a fire in a zero visibility or near zero visibility smoke-filled building to be able to more easily find the building exit door to which the door holding device 10 is attached so that he or she may safely exit the building). In one or more embodiments, the locating device 520 may include (i) a light emitting device for emitting a visual signal from the door holding device 10, and/or (ii) an audio device for emitting an audible signal from the door holding device 10. For example, when the locating device 520 is in the form of a light emitting device, it may comprise one or more flashing light emitting diode (LED) lights that visually direct a person to the door 54. As another example, when the locating device 520 is in the form of an audio device, it may comprise one or more alarms or sirens that audibly direct a person to the door 54.

The personnel detection device 540 is configured to detect the presence and/or location of emergency response personnel (e.g., one or more firefighters) inside and/or outside a building in which the door holding device 10 is disposed. In one or more embodiments, the emergency response personnel detection system 540 may comprise one or more radio frequency identification readers or transmitters and/or one or more radio frequency identification tags. Each radio frequency identification tag may be attached to a respective person (e.g., a firefighter) and/or object (e.g., additional door holding devices or markers inside and/or outside the structure) disposed inside the building structure so that a presence and/or location of the person (e.g., a firefighter) is capable of being determined by the emergency response personnel detection system. In these one or more embodiments, the one or more components 540 of the emergency response personnel detection system that are disposed on the door holding device 10 may comprise the one or more radio frequency identification readers or transmitters of the system. In other embodiments, the personal detection device 540 can be configured to determine how long a firefighter has been inside the building and/or how long the firefighter had been inside if they are no longer inside the building and/or how long since they left the building.

In other embodiments, the personnel detection device 540 can detect and/or transmit data of a firefighter's bodily functions, for example, vital signs, such as but not limited to blood pressure, heart rate, respiratory rate, body temperature, etc.). Still further, the personnel detection device 540 can detect and/or transmit data on environmental conditions within a structure (e.g., temperature, relative temperature, temperature fluctuations, smoke composition, smoke density, ambient air gas composition (e.g., carbon monoxide, oxygen, natural gas, etc.), measurement of the ambient air gases, etc.).

As mentioned above, in the illustrative embodiment, the body assembly 20 of the door holding device 10 may be formed from a suitable plastic or metallic material, which is capable of being elastically deformed. In the illustrative embodiment, the plastic or metallic material, which is used for forming the body assembly 20 of the door holding device 10, is sufficiently strong to withstand the forces exerted on the door 54 by the fire hose 58 being dragged through the opening 60 between the door frame 56 and the door 54 (see FIG. 4). That is, the door holding device 10 maintains the door 54 in the predetermined position as the fire hose 58 is dragged through the door opening 60 by the firefighting personnel.

Advantageously, the door holding device 10 controls and limits the amount of air moving into a building structure by temporarily, or permanently holding a door in a mostly closed or other desired position during firefighting or other commercial or domestic operations and tasks. The door holding device 10 is capable of being deployed by a single firefighter or other person from either side of the door, thereby holding the door in place in a mostly closed position, while allowing fire hoses and firefighting personnel and equipment, or other persons or equipment, to pass through the threshold of the door. The quick-release mechanism 12 of the door holding device 10 described above allows a firefighter, or other person, to remove the device 10 with a gloved or ungloved hand in zero or clear visibility during an emergency egress situation or other situation. Because of its operability and efficacy, the door holding device 10 described above is an important life-saving tool for firefighters and other emergency response personnel. Advantageously, the door holding device 10 is capable of safely and reliably controlling both exterior and interior doors, inward and outward swinging commercial and residential doors, without disrupting their desired working objective.

It is readily apparent that the door holding device offers numerous advantages. First, the door holding device 10 described herein is capable of securely fixing a door in place, while resisting forces that commonly occur during firefighting operations, such as those forces created by the advancing of the fire hose. Advantageously, the door holding device 10 described herein allows a firefighting crew to restrict the amount a door will be able to swing open, and the device fixes the door in a predetermined position so that fire hose line may be advanced into the building structure to extinguish a fire. Second, the door holding device 10 incorporates a "quick release" feature to allow firefighting personnel to rapidly open the door and exit the structure with a minimal amount of manipulation. Finally, the door holding device 10 effectively restricts the amount of airflow through a door opening of the building structure and therefore, controls flow path while aiding in the restriction of fire growth. By controlling the flow path through the building, the door holding device 10 helps to keep fire growth in a reduced state, thereby allowing for a safer working environment for firefighters, and more time for victim rescue and conservation of civilian property.

In one or more embodiments, the door holding device 10 described herein may be deployed by a single member of the first firefighting crew to enter a building. Once deployed, it will fix a door in any desired position and will open only enough to allow for the entry of firefighters and fire hose lines to be advanced into the building. This will restrict the amount of air inflow, and therefore control the flow path, while aiding in restricting fire growth. Advantageously, the first and second clamp devices 22, 38 of the door holding device 10 are capable of being easily engaged and disengaged with the door 54 and door frame 56 so that the door holding device 10 can be positioned where needed.

The door holding device 10 is reusable for multiple door holding installations, but also may be used for a single use installation (e.g., if the device 10 is damaged in a building fire). In one or more embodiments, the door holding device 10 may be joined with other tools, equipment, and personal protective gear (i.e., firefighting equipment and gear), and may be carried on, and deployed by a single person (i.e., a single firefighter). The quick-release handle mechanism 12 of the door holding device 10 is easily releasable by a single hand of a person (i.e., one hand of a firefighter). Advantageously, the door holding device 10 is readily adaptable to virtually any door assembly, and is capable of withstanding the extreme temperatures and conditions of the firefighting environment (e.g., if the door holding device 10 is constructed of a durable metallic material). The door holding device 10 is able to be placed into use from either side of a door, while the user of the device 10 is either inside or outside of the building structure. As explained above, the door holding device 10 is capable of withstanding forces acting on the device 10 while it is in use (e.g., those forces generated by the movement of the fire hose by the firefighting personnel). Also, the door holding device 10 allows the door to withstand forces applied thereto while the device 10 is holding the door in place (e.g., those forces acting on the door as a result of the movement of the fire hose by the firefighting personnel).

Figure 6:
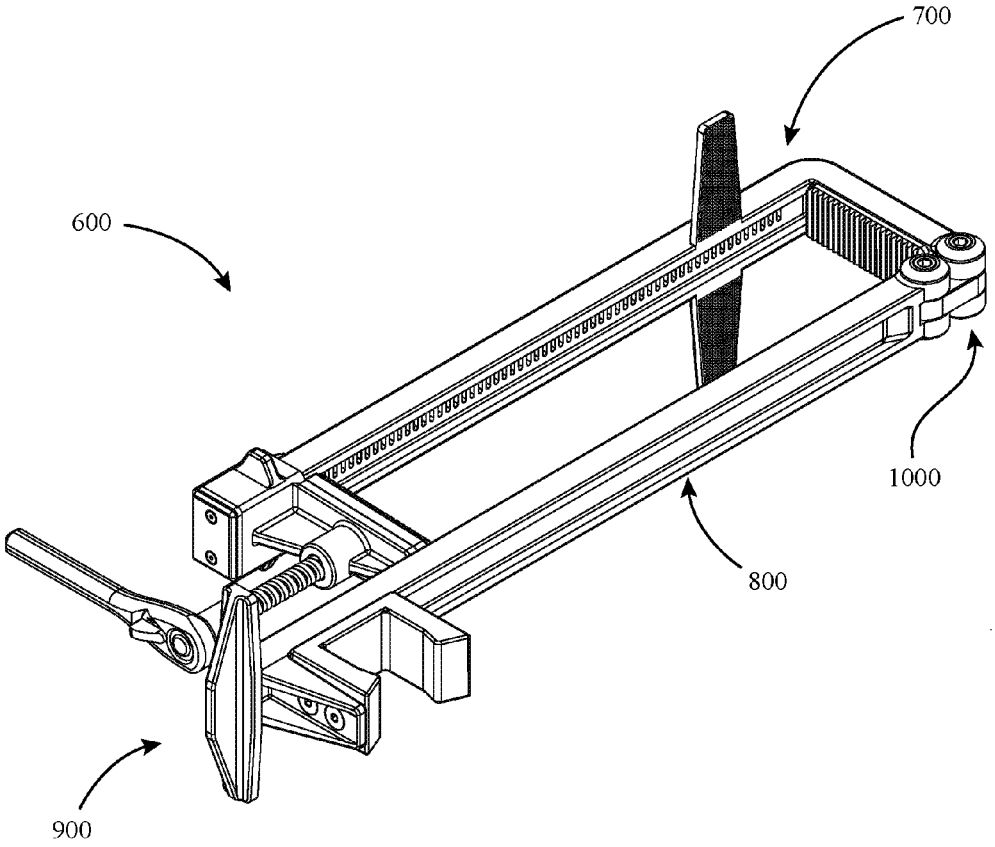
FIG. 6 is a perspective view of another example embodiment of a door holding device in accordance with an aspect of the innovation.
Figure 6A:
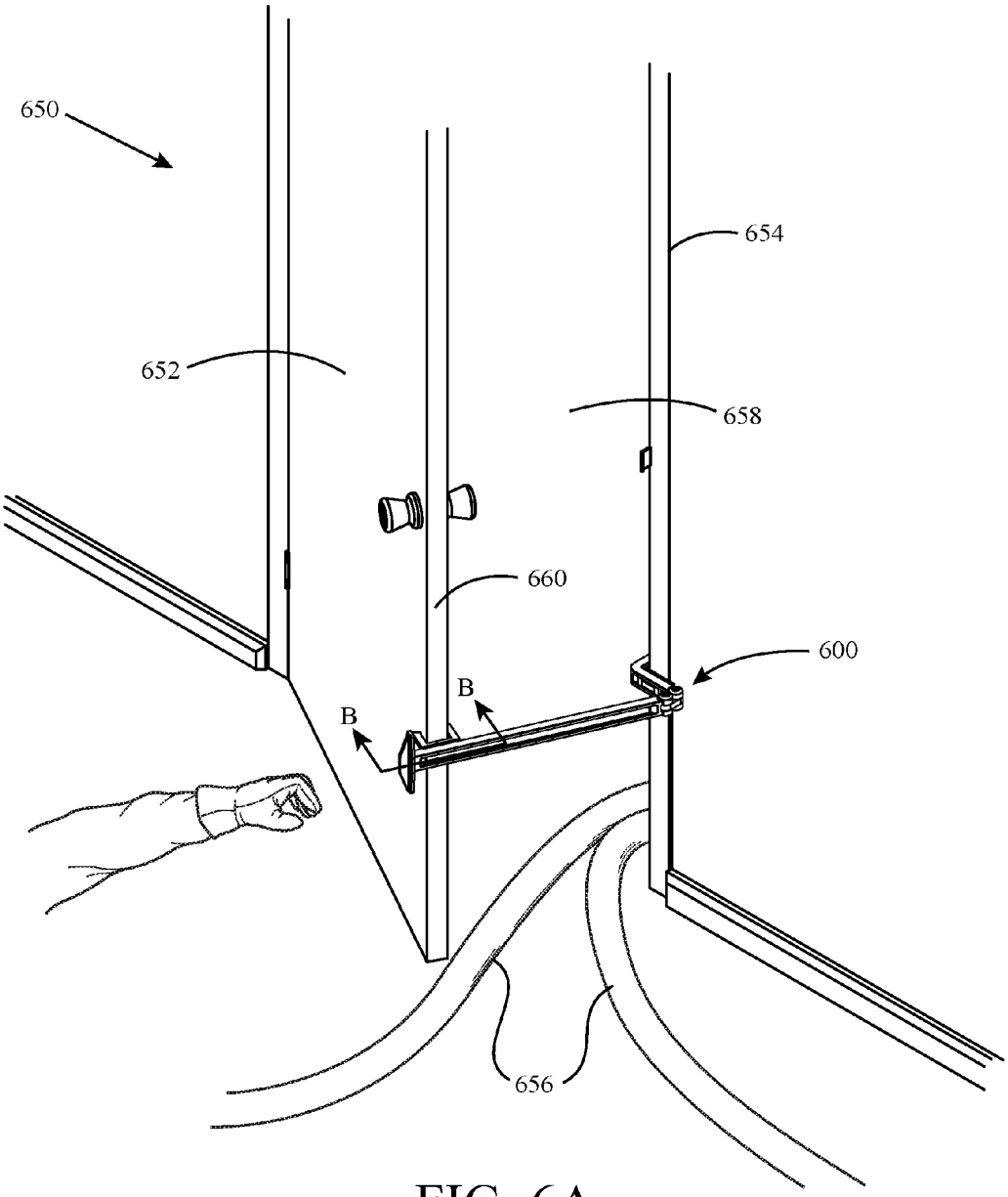
FIG. 6A is a view of a door structure incorporating the innovative door holding device in accordance with an aspect of the innovation.

FIGS. 6-30 illustrate another example embodiment of a door holding device 600 in accordance with an aspect of the innovation. Referring to FIGS. 6 and 6A, the door holding device 600 includes a first arm assembly 700, a second arm assembly 800, a movable clamping mechanism 900, and a pivot device 1000 that pivotally connects the first and second arm assemblies 700, 800. As will be described in more detail further below, the door holding device 600 illustrated in FIGS. 6-30 is configured to attach to a structure 650. More specifically, the door holding device 600 attaches to a door 652 and a door frame 654 to securely hold the door 652 in a partially open (or closed) position to allow fire equipment (e.g., fire hoses) 656 through an opening or gap 658 in the partially open door structure 650.

The structure 650 can be any type of structure, such as but not limited to a residential dwelling, a commercial or industrial building, schools, churches, etc. In addition, the door holding device 600 can be used on an inward or out swinging door. Still further, the innovative door holding device allows firefighters to view smoke emitting from the doorway where the door holding device is applied, which allows the firefighters to observe changes in fire conditions throughout the emergency. Observation of changes in fire conditions is a very large variable in tactical decision making. Still further, more than one door holding device 600 can be used within a structure to limit and control the air flow into and/or within the building. For example, if one door holding device 600 is on the front door of a structure and another is on a door in a common hallway within the structure, the amount of air flow into and within the structure can be effectively controlled.

Referring to FIGS. 7-14, the first arm assembly 700 is adjustable and is configured to attach to a structure, such as but not limited to the door frame 654 as will be described further below. The first arm assembly 700 includes an L-shaped arm 710 and a support structure 750. The L-shaped arm 710 includes a first longitudinal part 712 having a proximate (first) end 714 and a distal (second) end 716, and a stationary part 718 having a proximate (first) end 720 and a distal (second) end 722. A channel 724 is defined along a first longitudinal axis A1 on each side of the longitudinal part 712 such that the longitudinal part has an I-beam shaped cross-section. The longitudinal part 712 further includes a track 726 having recesses 728 is defined on one or both sides therein that facilitates the movement of the movable clamping mechanism 900 along the longitudinal part 712 as will be described further below.

The stationary part 718 has a second longitudinal axis A2 and extends from the distal end 716 of the longitudinal part 712 such that the first and second longitudinal axes A1, A2 are substantially perpendicular to each other. The stationary part 718 includes a stationary pad 730 (e.g., rubber pad) disposed on a face 731 thereon that includes teeth 732. The teeth 732 may be made from a rigid material, such as but not limited to metal, that are configured to bite into or grip the structure (e.g., door frame) when the pad 730 is compressed as will be described further below. In another embodiment, the teeth 732 may be an integrated part of the stationary part 718 and thus, integrated directly on the face 731 of the stationary part 718.

Figure 7:
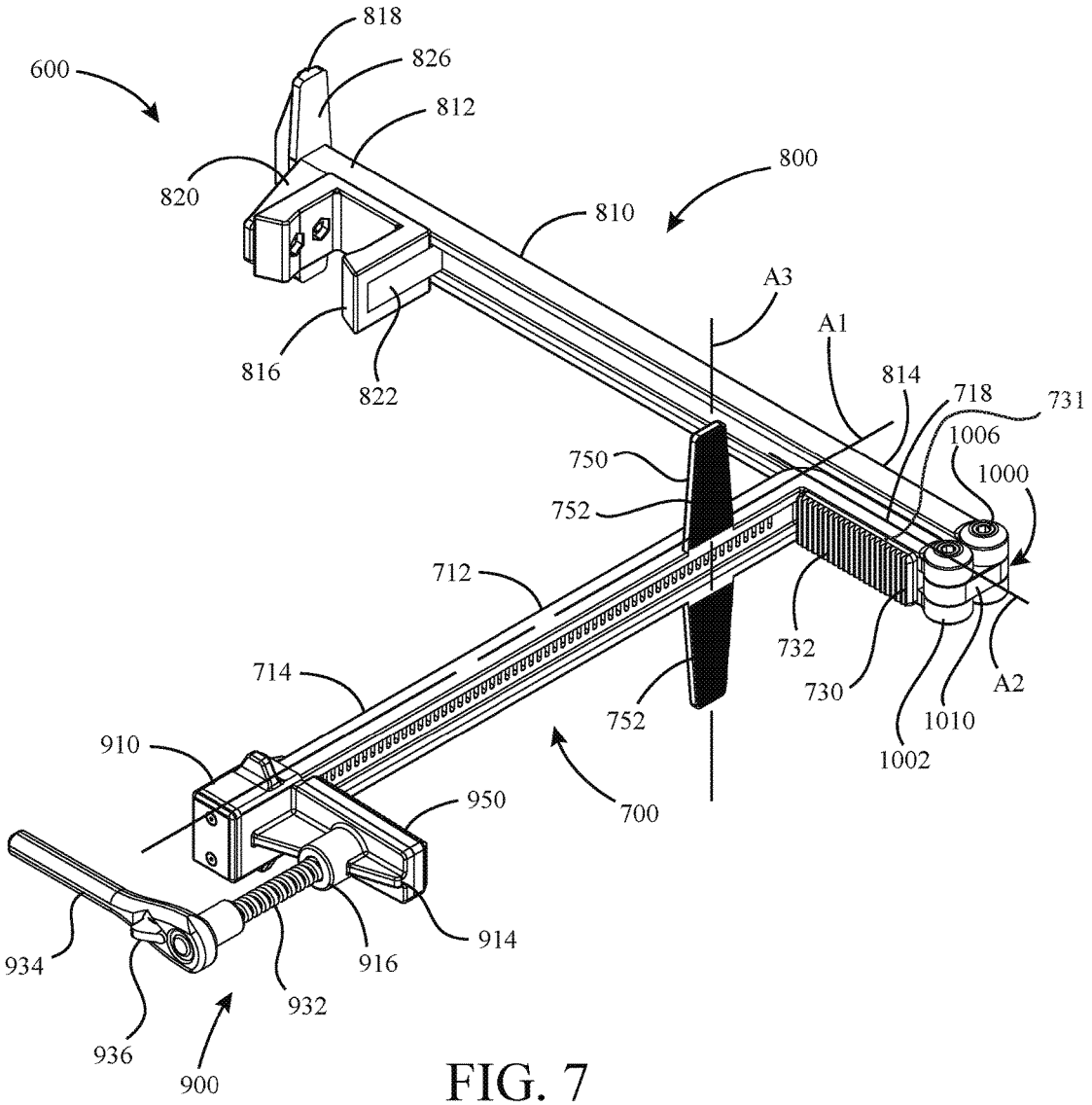
FIGS. 7 and 8 are opposite end perspective views of the innovative door holding device of FIG. 6 in accordance with an aspect of the innovation.
Figure 8:
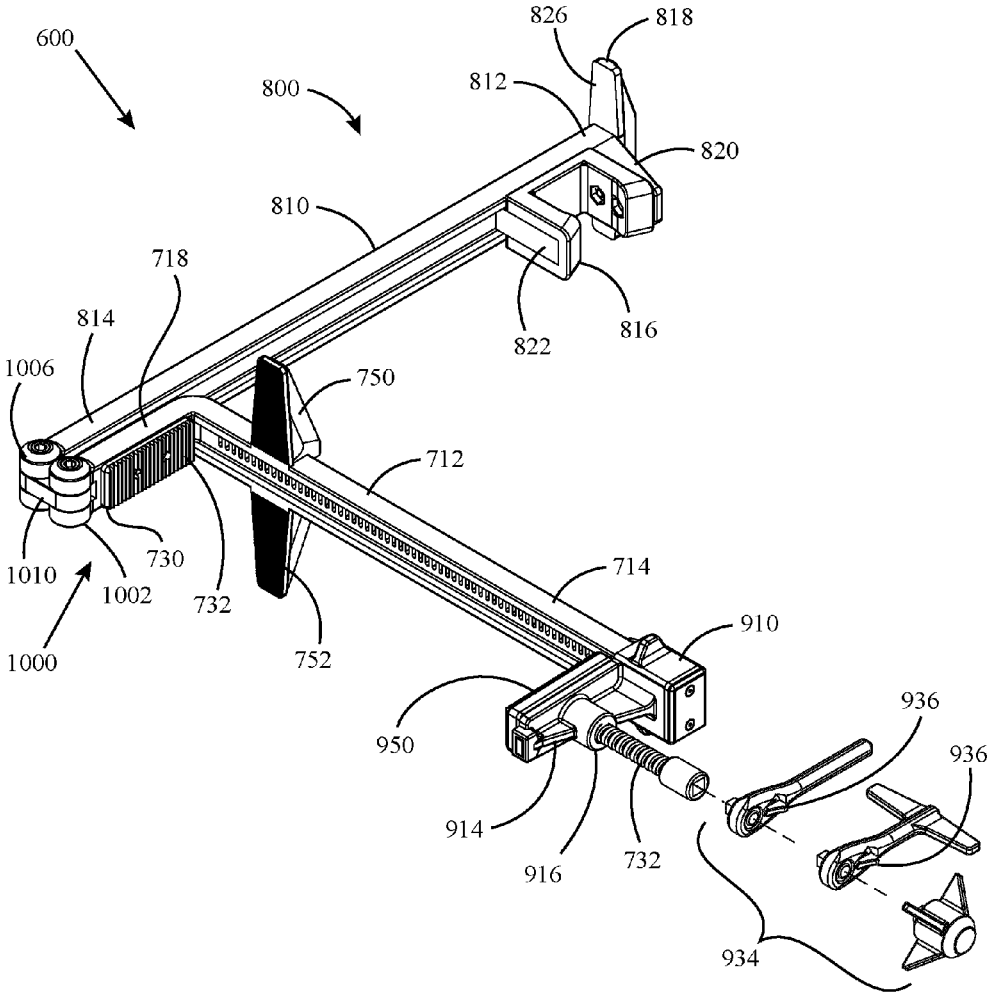
Figure 9:
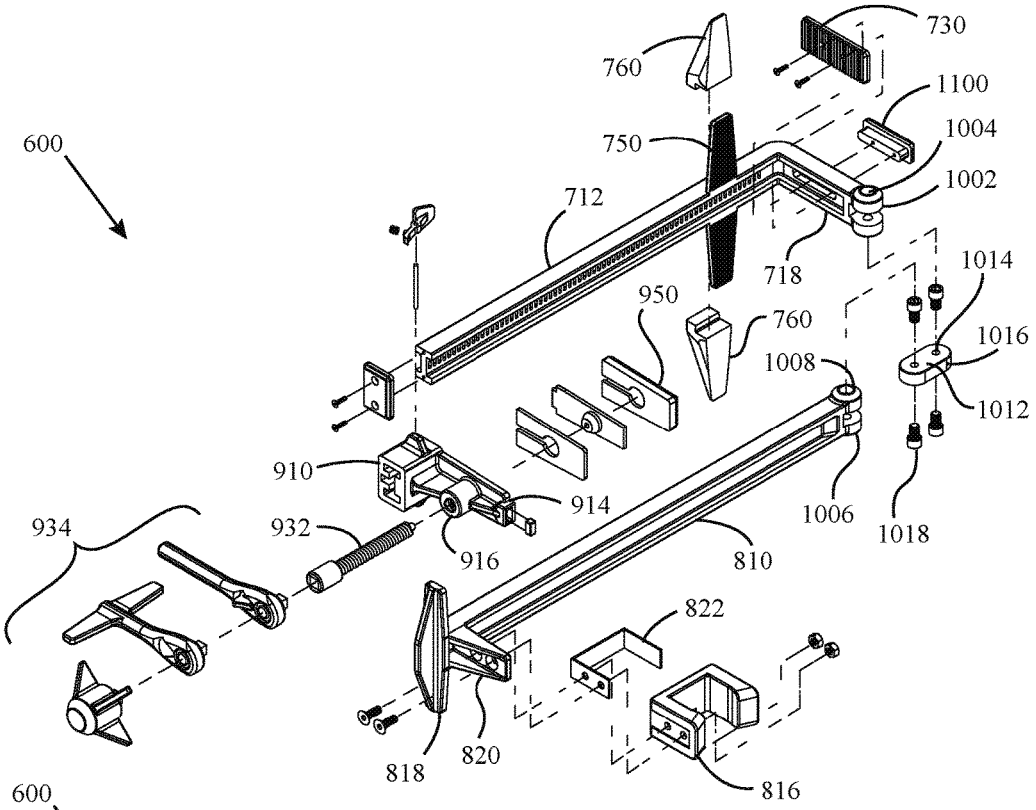
FIG. 9 is an exploded view of the innovative door holding device of FIG. 6 in accordance with an aspect of the innovation.

The support structure 750 includes a pair of fins 752 that extend along a third longitudinal axis A3 from each side of the longitudinal part 712 such that the first, second, and third longitudinal axes A1, A2, A3 are all substantially perpendicular to each other, see FIG. 7. A pad (e.g., rubber pad) 754 having teeth (e.g., metal teeth) 756 are attached to a contacting face or surface 758 of each fin 752 such that the teeth 756 bite into or grip the structure (e.g., door frame) to stabilize the door holding device 600 in a vertical direction. In another embodiment, the teeth 756 may be an integrated part of each fin 752. In the example embodiment illustrated in the figures, the fins 752 have a tapered rectangular shape, but it is to be understood that the fins 752 can have any geometric shape, such as but not limited to square, triangular, circular, etc. In another embodiment, the support structure 750 may include attachable/detachable stabilizers or wedges 760 that fit onto the support structure 750 for additional stability.

Figure 22:
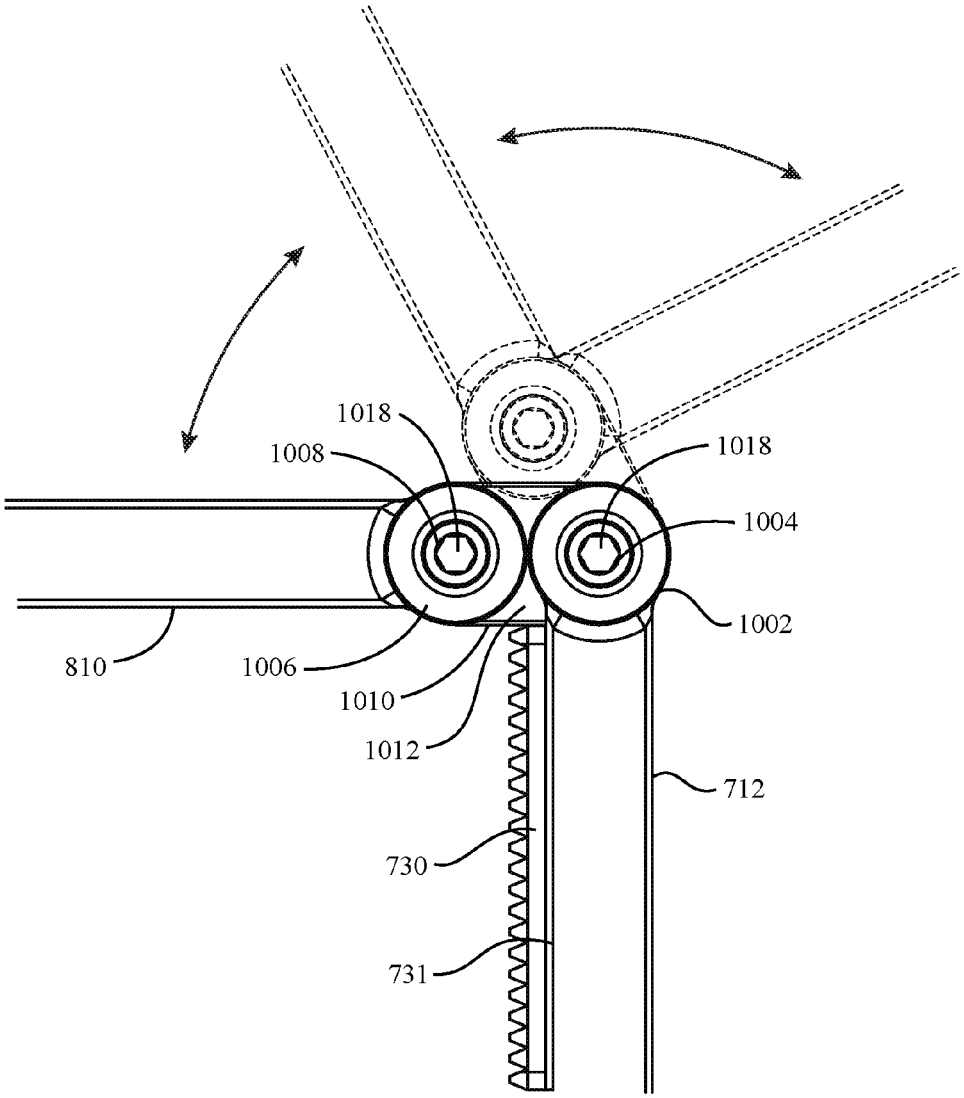
FIG. 22 is a close-up view of a pivot device in accordance with an aspect of the innovation.
Figure 22A:
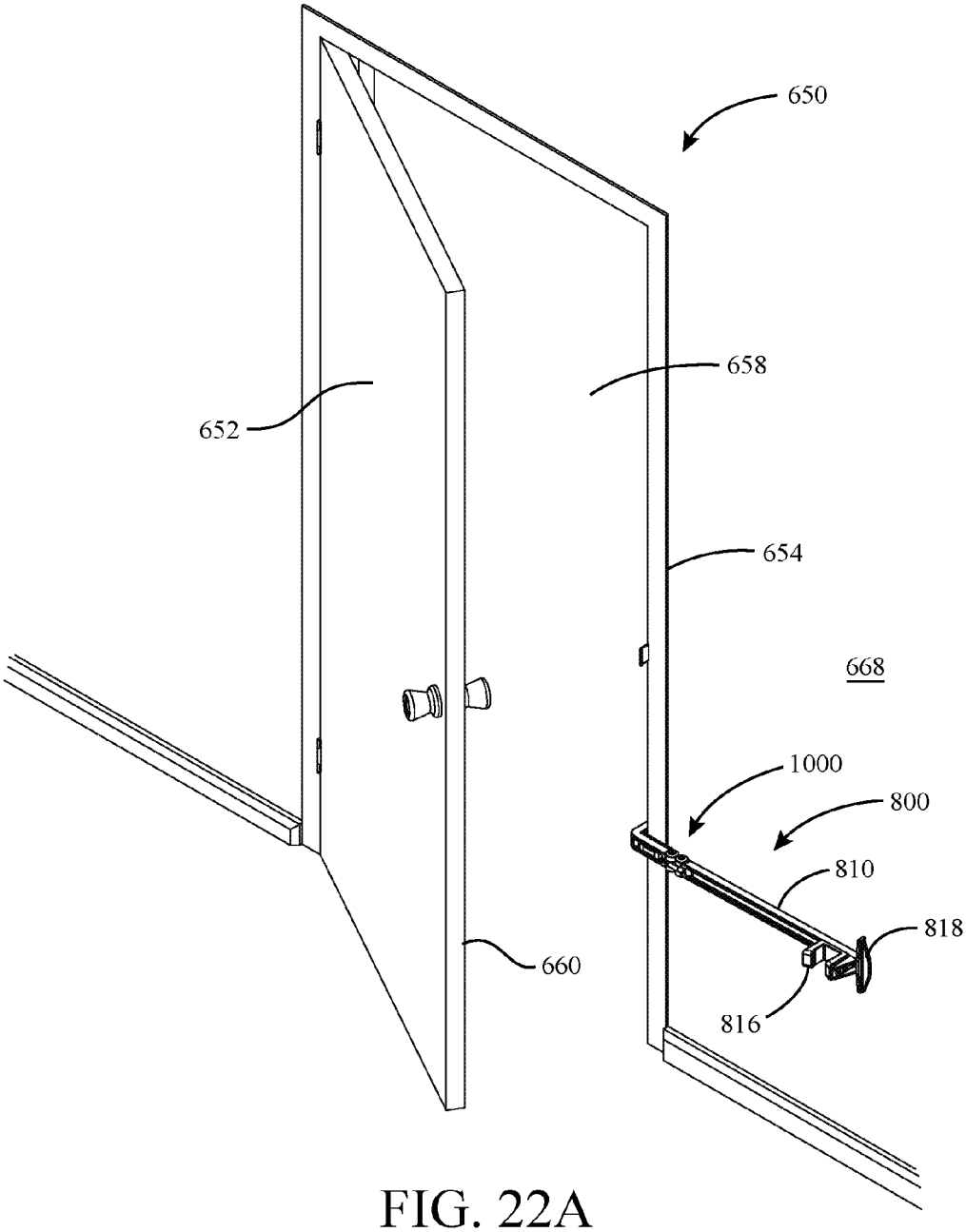
FIG. 22A is a view of the door holding device attached to the door structure but not attached to the door in accordance with an aspect of the innovation.

In other embodiments, the wedges 760 can be used to hold the door 652 in a desired position when a U-shaped holder 816 (described below) is disengaged from the door 652 and the second arm assembly 800 is out of the way, as shown in FIG. 22A. Still further, firefighters can use the wedges 760 individually or collectively to make up for a gap created in a the-shaped holder 816 when the thickness of a vertical end 660 of the door 652 is less than a width of U-shaped holder 816. Still even further, the wedges 760 can be used in conjunction with the movable clamping mechanism 900 to fill a gap if the door frame 654 is smaller than anticipated.

Figure 15:
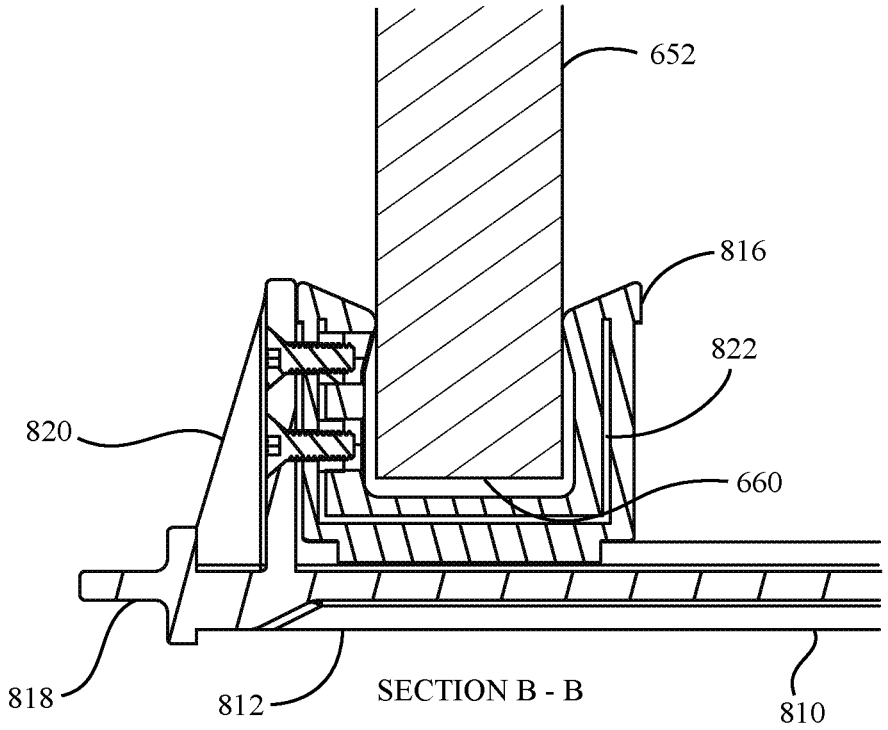
FIG. 15 is a close up view of a U-shaped holding device securing a door in accordance with an aspect of the innovation.

Still referring to FIGS. 7-14, the second arm assembly 800 includes a second longitudinal part 810 having a proximate (first) end 812 and a distal (second) end 814, a U-shaped holder 816 disposed at the proximate end 812, and a release device 818 also disposed at the proximate end 812. The U-shaped holder 816 is configured to receive a vertical end 660 of the door 652 to secure the door 652 in the partially open (or closed) position as shown in FIG. 15. The U-shaped holder 816 may be made from a rigid (e.g., metal), a resilient (e.g., rubber), or a spring like material that facilitates the quick and easy engagement and disengagement of the second arm assembly 800 from the door 652 while at the same time providing a high amount of friction to maintain the door 652 in the partially open position due to the hose 656 contacting the door. The U-shaped holder 816 attaches to an extended part 820 integrally attached to the proximate end 812 of the longitudinal part 810 via a bracket 822 and fasteners, as shown in FIG. 15.

Figure 16:
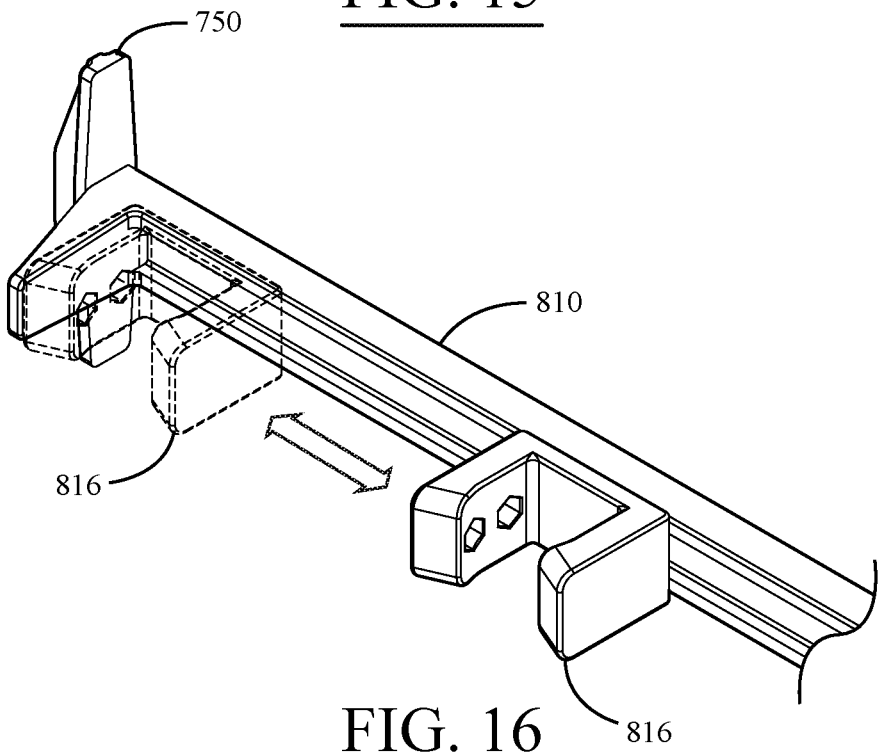
FIG. 16 is a close-up view illustrating an adjustable feature of the U-shaped holder in accordance with an aspect of the innovation.
Figure 17:
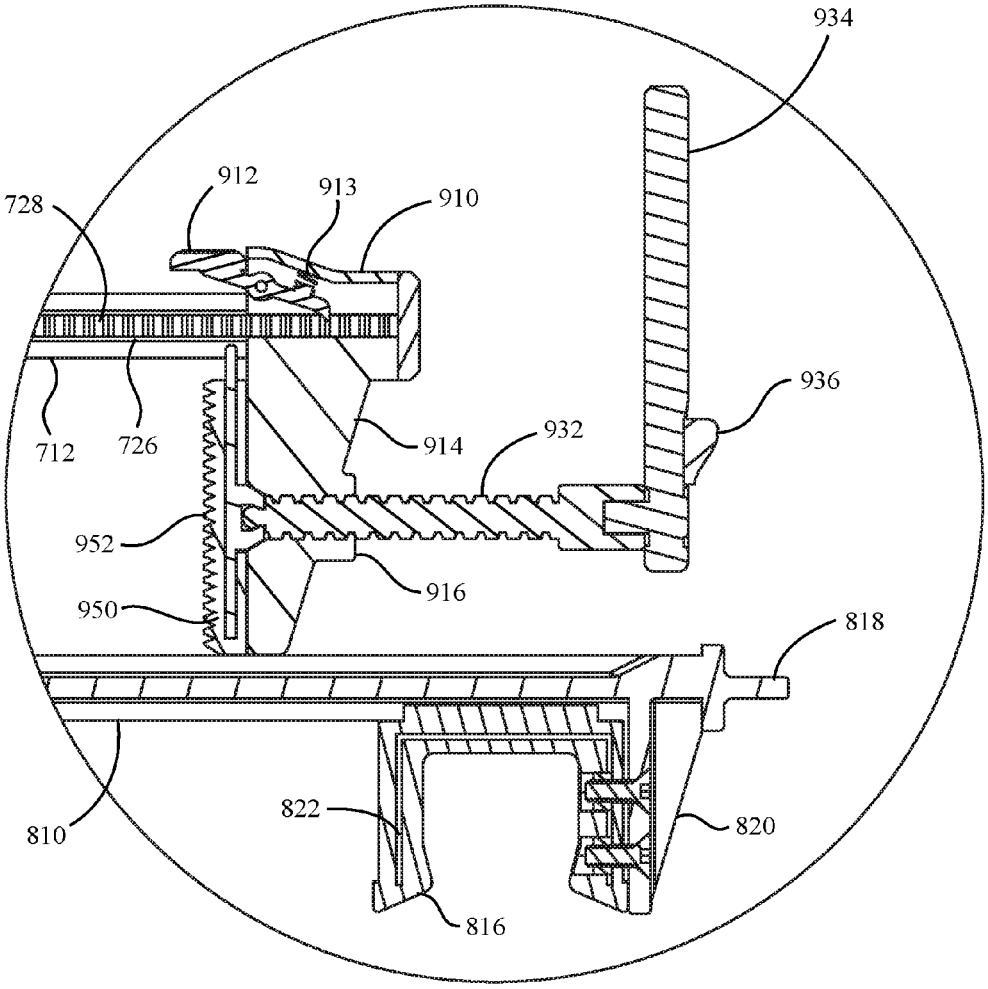
FIGS. 17 and 18 are close-up views of a movable clamping mechanism in a non-actuated state and an actuated state respectively in accordance with an aspect of the innovation.
Figure 18:
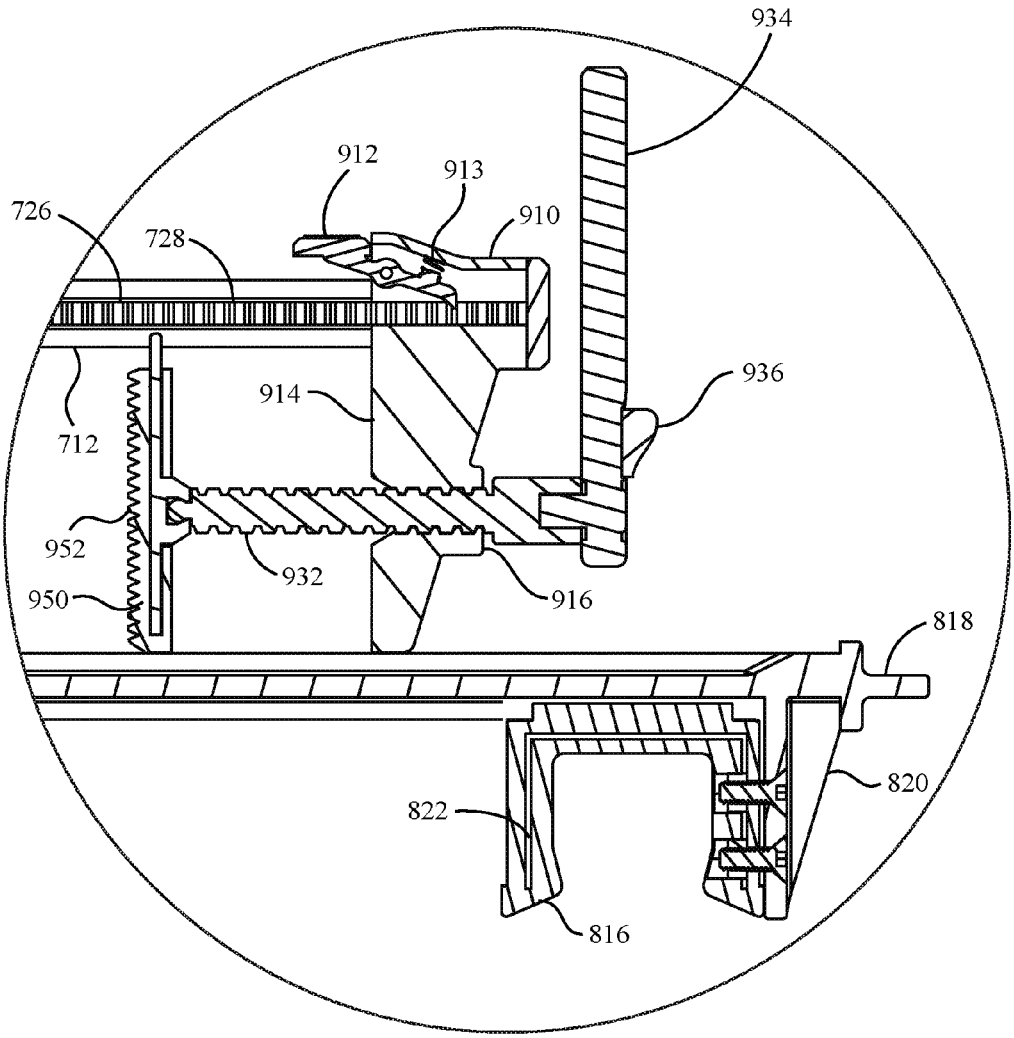
Figure 19:
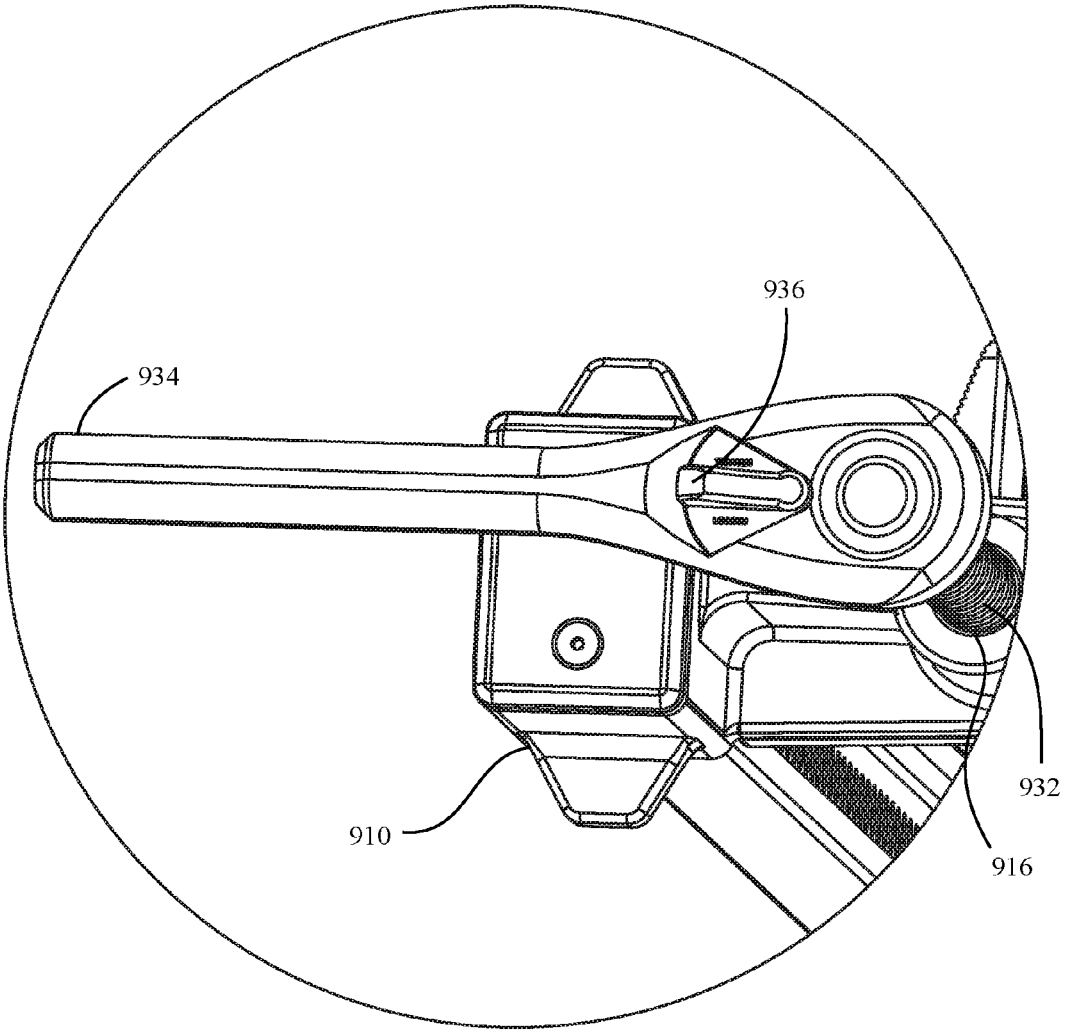
FIG. 19 is a close-up view of a handle of the movable clamping mechanism in accordance with an aspect of the innovation.
Figure 20:
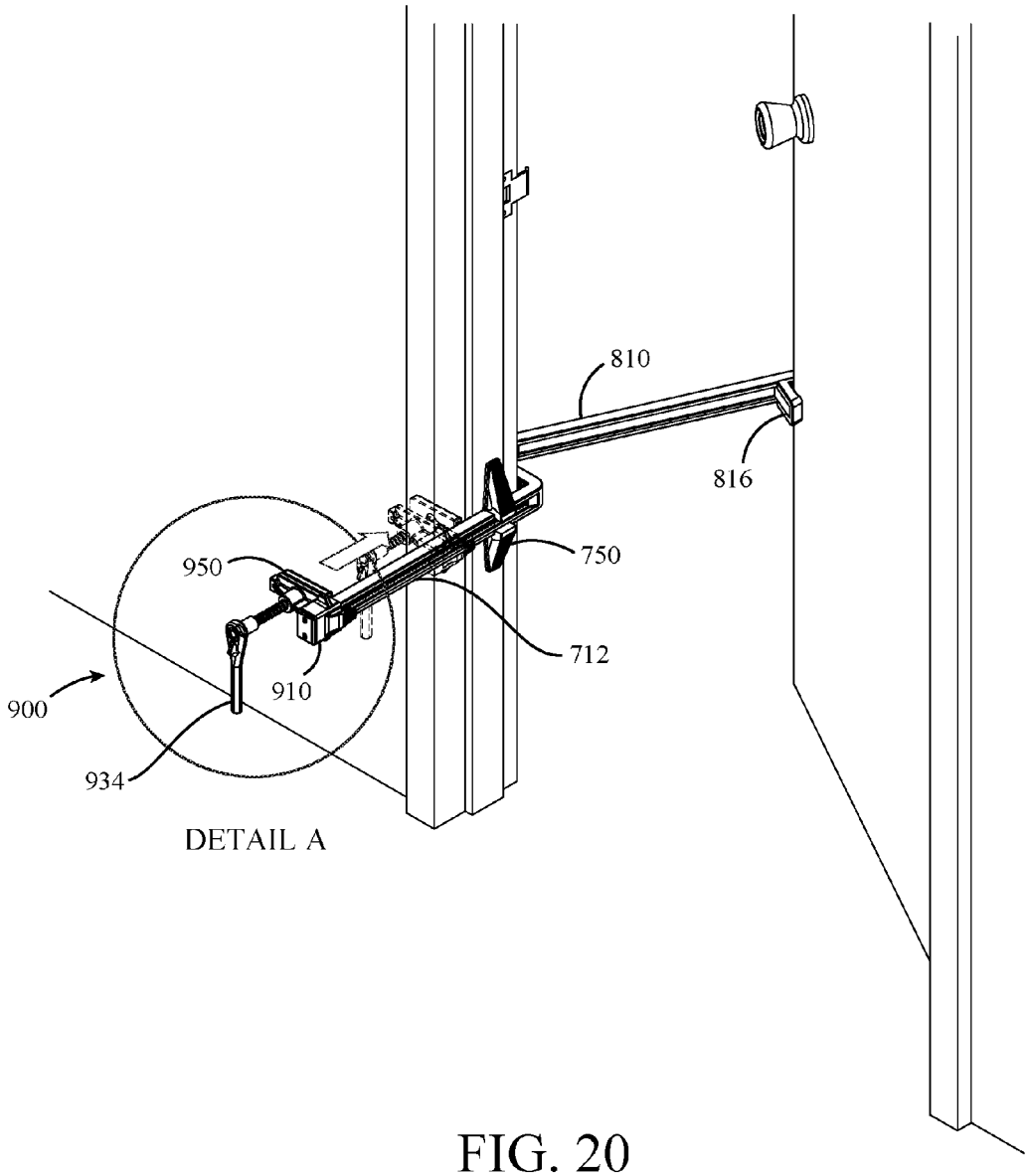
FIGS. 20 and 21 are views of the door structure illustrating the clamping process of the movable clamping mechanism in accordance with an aspect of the innovation.
Figure 21:
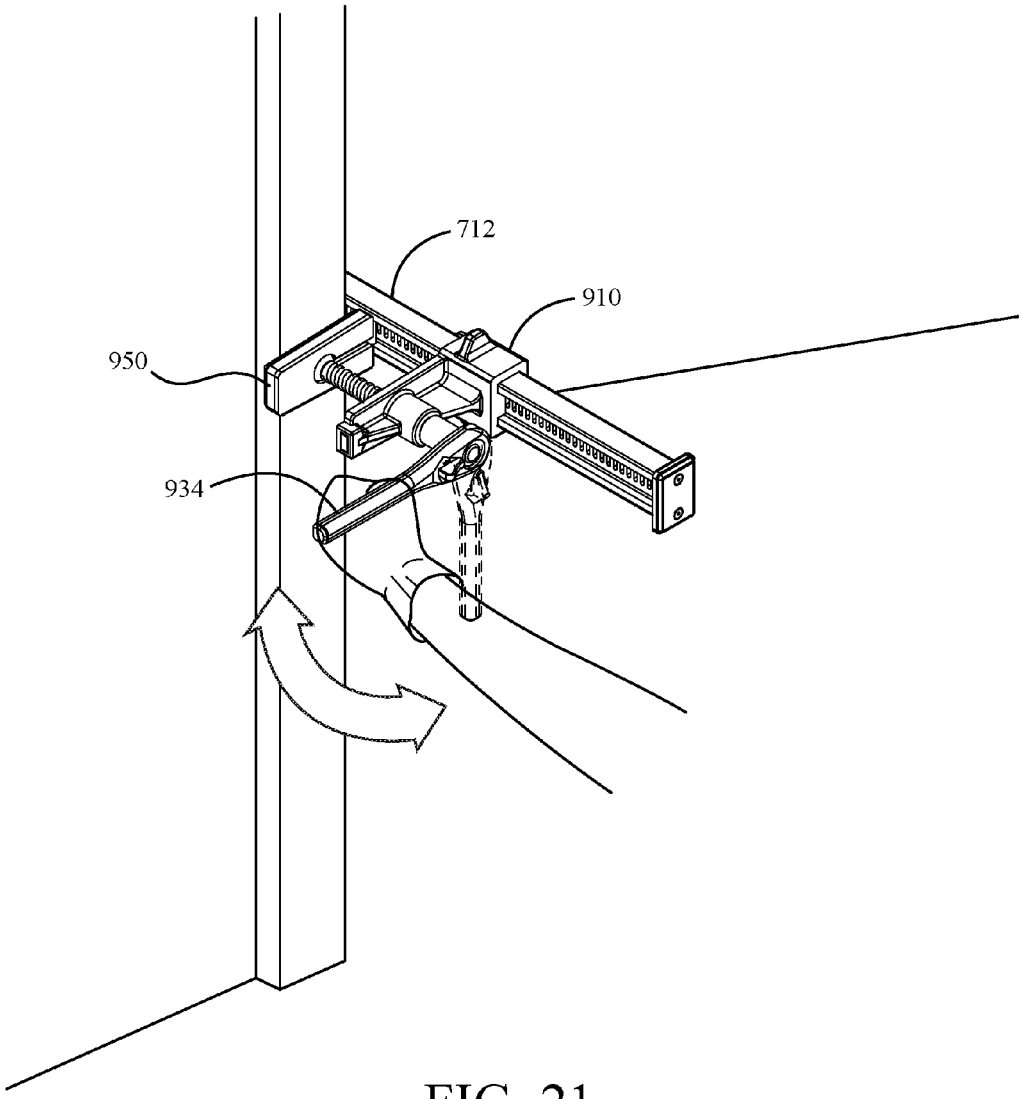

In another embodiment illustrated in FIG. 16, the U-shaped holder 816 may be slidable along the longitudinal part 810 of the second arm assembly 800, as illustrated by the double sided arrow. This allows the opening 658 of the door 652 to be adjusted to different sized openings or gaps 658 (e.g., 18", 16", 14", 12", etc.). The U-shaped holder 816 can be adjustable via any mechanical means, such as but not limited to apertures defined in the longitudinal part 810 that receive a projection from the U-shaped part 816, friction fit, clips, etc. In another embodiment shown in FIG. 29, the U-shaped holder 816 may pivot like a hinge that would further facilitate adjustability of the opening 658.

Referring again to FIGS. 7-14, the release device 818 is disposed on an end face 824 at the proximate end 812 of the second longitudinal part 810 and includes a pair of fins 826 that extends substantially perpendicular to the second longitudinal part 810. In the example embodiment illustrated in the figures, the fins 826 have a tapered rectangular shape, but it is to be understood that the fins 826 can have any geometric shape, such as but not limited to square, triangular, circular, etc. The release device 818 is configured to allow the users to hand strike the release device 818 to disengage the second arm assembly 800 from the door 652.

Figure 27:
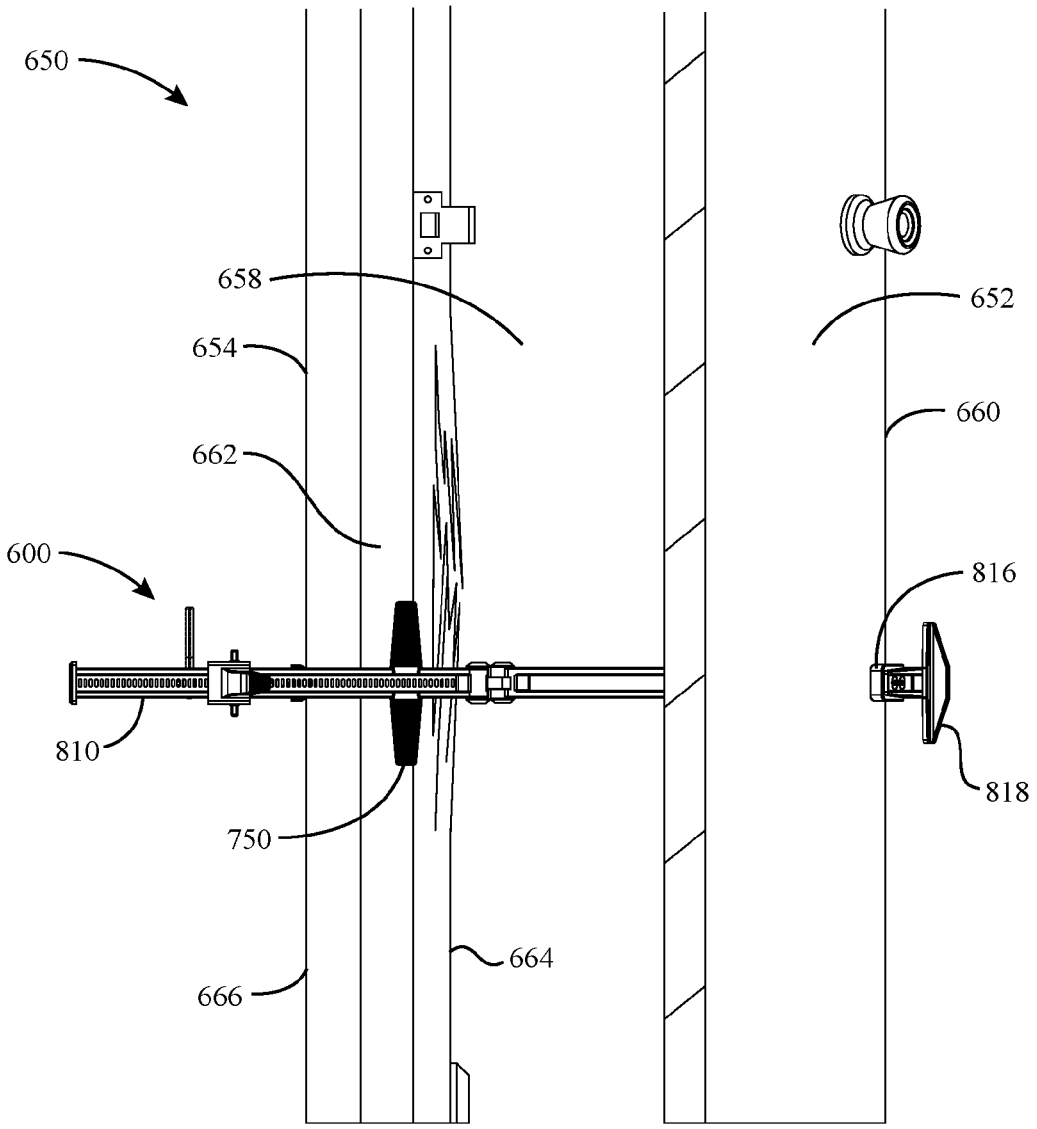
Figure 28:
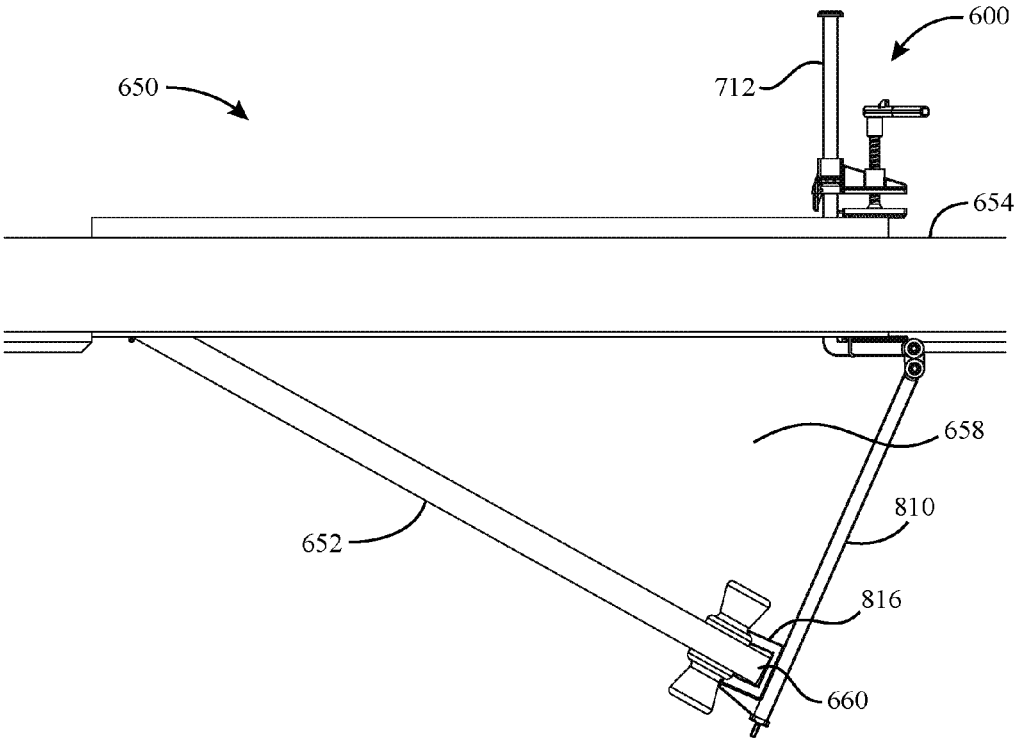
Figure 29:
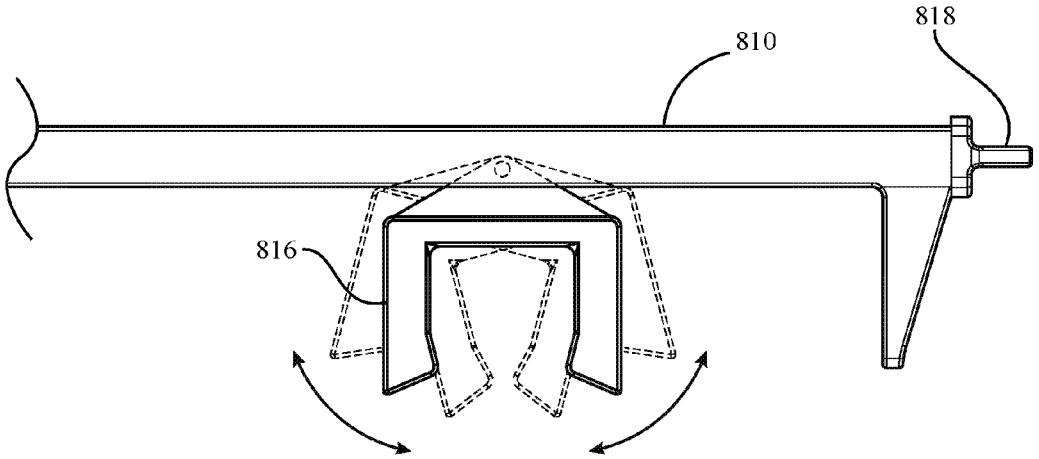
FIG. 29 is a close-up view illustrating a pivoting feature of the U-shaped holder in accordance with an aspect of the innovation.
Figure 30:
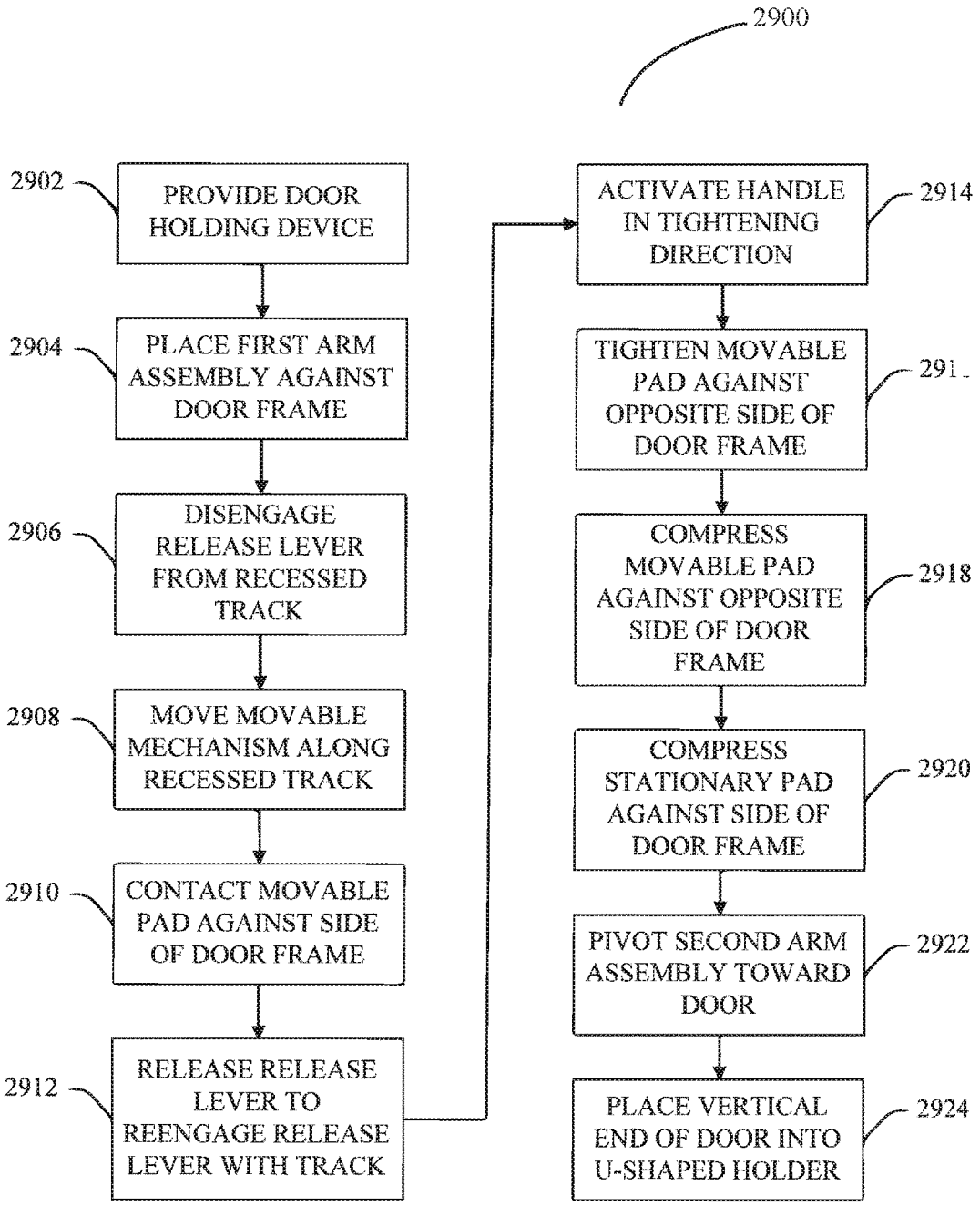
FIG. 30 is a block diagram illustration of a method of attaching the innovative door holding device to a door frame structure in accordance with an aspect of the innovation.

Referring to FIGS. 7-14 and 17-21, the movable clamping mechanism 900 is configured to clamp the door holding mechanism to the structure 650. In addition, when firefighters arrive to the scene of a fire, the primary entry door to the structure is closed and sometimes locked. When it is locked, a set of iron tools are used to force entry. When this is done, the door frame 654 can be severely damaged and may crack and/or splinter if the door frame is wood. Due to this disfiguration, a strong clamping force is required to crush the splintered pieces back into place so that the door holding device can be adequately applied to the door frame. As shown in FIG. 27, one side 664 of the door frame 654 is splintered and the movable clamping mechanism 900 provides enough force to force the splintered door frame back into place.

The movable clamping mechanism 900 travels along the first longitudinal axis A1 of the longitudinal part 712 and includes a traveler 910 and clamp tightening device 930. The traveler 910 engages one or more sides of the longitudinal part 712 and is configured to slide along the longitudinal part 712. The traveler 910 includes a quick release lever 912 that facilitates quick movement of the traveler 910 along the longitudinal part 712. The quick release lever 912 engages the recesses 728 defined on one side of the track 726 to hold the traveler 910 (and accordingly, the movable clamping mechanism 900) in position when the door holding device 600 is attached to the structure 650. To move the traveler 910 and hence, the movable clamping mechanism 900 along the longitudinal part 712, the user presses the quick release lever 912 to disengage the quick release lever 912 from the recesses 728 defined in the track 726 and slides the movable clamping mechanism 900 along the longitudinal part 712. To reengage, the user simply releases the quick release lever 912 and a spring 913 biases the quick release lever 912 back into one of the recesses 728.

The traveler 910 further includes an extension part 914 that extends from the longitudinal part 712 substantially parallel to the stationary part 718. Thus, the extension part 914 and the stationary part 718 form an adjustable U-shaped clamp. A threaded aperture 916 is defined in the extension part 914 that facilitates the tightening of the door holding device 600 against the door frame 654 as will be described below.

The clamp tightening device 930 includes a threaded rod 932 threadedly disposed in the threaded aperture 916 and a handle (or knob) 934 having a switching lever 936 to switch the clamp tightening device 930 between a tightening state and a release state, and a movable pad 950. The threaded rod 932 threads through the threaded aperture 916 and attaches to a rear of the movable pad 950. During operation, the clamp tightening device 930, via movement of the handle 934, tightens the movable pad 950 against the door frame 654. Thus, during attachment of the door holding device 600 to the structure 650, the movable pad 950 compresses against the door frame 654, which in turn forces the stationary part 718 to compress against an opposite side of the door frame 654 to secure the door holding device 600 to the door frame 654. To release the door holding device 600 from the door frame 654, the user simply switches the switching lever 936 to the release position and ratchets the clamp tightening device 930 via the handle 934 to loosen the movable pad 950 from the door frame 654.

In addition, the handle 934 can include indicators (e.g., markings, color indicators, etc.) to allow firefighters to quickly recognize if the clamp tightening device 930 is in a ready position and set up to tighten to or removed from the door frame 654. The indicators can save time, which is critical in an emergency situation.

Similar to the stationary part 718, the movable pad (e.g., rubber pad) 950 includes teeth 952. The teeth 952 may be made from a rigid material, such as but not limited to metal, that are configured to bite into or grip the door frame 654 when the movable pad 950 is compressed against the door frame 654.

Referring to FIGS. 7-10, 22, and 22A, the pivot device 1000 is configured to allow the first and second arm assemblies 700, 800 to pivot with respect to each other. The pivot device 1000 allows the first arm assembly 700 if the door holding device 600 to remain attached to the door frame 654 while allowing the second arm assembly 800 to pivot out of the way (e.g., against a wall 668 of the structure 650). This allows the firefighters to move freely through the door opening 658 without the risk of having their clothes and other equipment inadvertently get caught on the door holding device 600.

The pivot device includes a first hinge 1002 having a first aperture 1004 defined therein and integrally attached to the distal end 722 of the stationary part 718 and a second hinge 1006 having a second aperture 1008 defined therein and integrally attached to the distal end 814 of the second longitudinal part 810. The pivot device 1000 further includes a band 1010 and a face (surface) 1012 having a first and second band apertures 1014, 1016 defined therein. The first and second hinges 1002, 1006 are connected to each other with the band 1010 and fasteners 1018 extend through the first and second apertures 1004, 1008 and through the respective first and second band aperture 1014, 1016. The pivot device 1000 allows the first and second arm assemblies 700, 800 to pivot with respect to each other, as illustrated by the double sided arrows in FIG. 22. Both the first and second hinges 1002, 1006 are independent of each other thus, the first arm assembly 700 can pivot independently of the second arm assembly 800 and vice versa.

Figure 23:
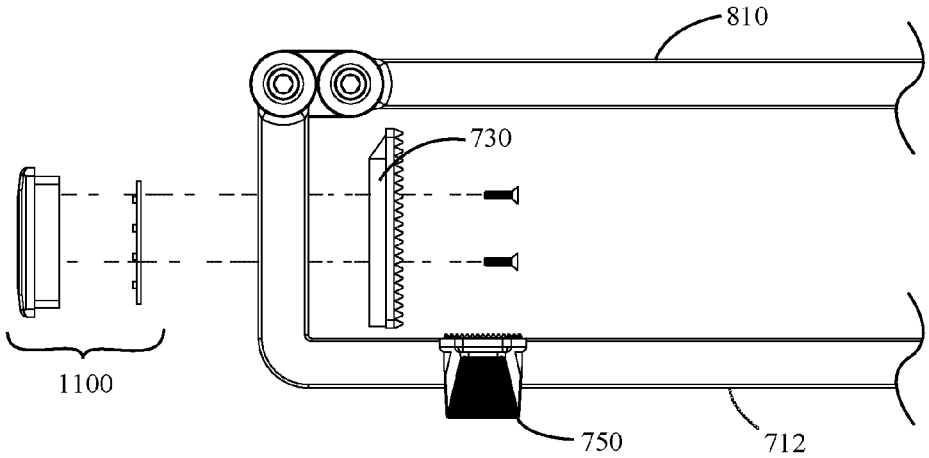
FIGS. 23 and 24 are close-up views of a wireless communicator in accordance with an aspect of the innovation.
Figure 24:
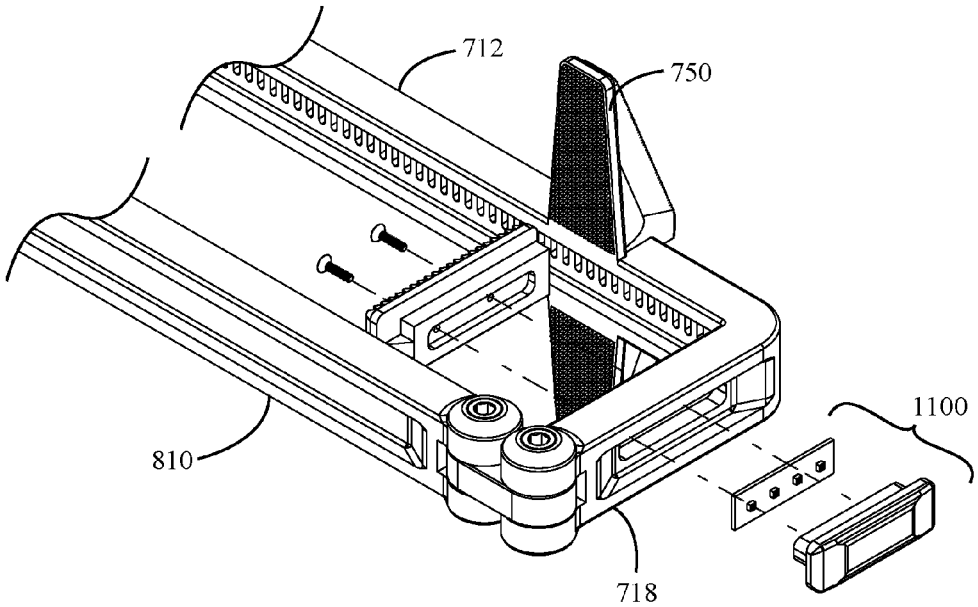

Referring to FIGS. 23 and 24, the door holding device may further include an electronic wireless communicator (e.g., transmitter and/or receiver) 1100 that can communicate with an external electronic system to be used as described above, a locating device 520, a personnel detection device 540, a visual and/or audio warning device, etc. As shown in FIGS. 23 and 24, the wireless communicator 1100 may be located in the stationary part 718 of the first arm assembly 700. It is to be understood, however, that the wireless communicator may be located in another portion of the door holding device 600 such as in the second arm assembly 800. Thus, in this example embodiment, the wireless communicator 1100 can detect and/or transmit data of a firefighter's bodily functions or vital signs, such as but not limited to blood pressure, heart rate, respiratory rate, body temperature, etc.).

Still further, the wireless communicator 1100 can detect and/or transmit data on environmental conditions within a building (e.g., temperature, relative temperature, temperature fluctuations, smoke composition, smoke density, ambient air gas composition (e.g., carbon monoxide, oxygen, natural gas, etc.), measurement of the ambient air gases, etc.

Figure 10:
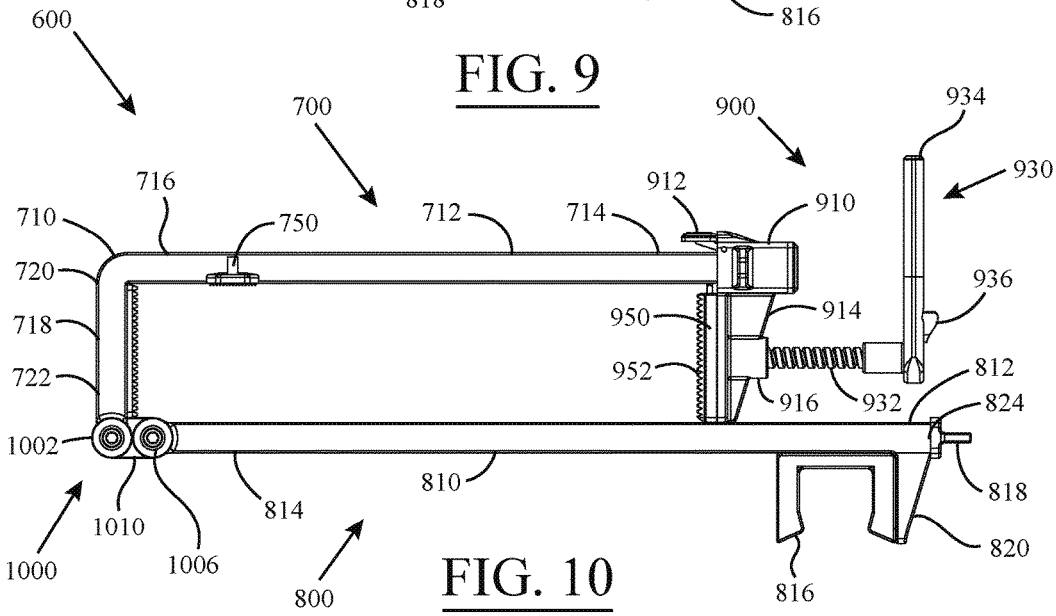
FIG. 10 is a side view of the innovative door holding device of FIG. 6 in accordance with an aspect of the innovation.
Figure 11:
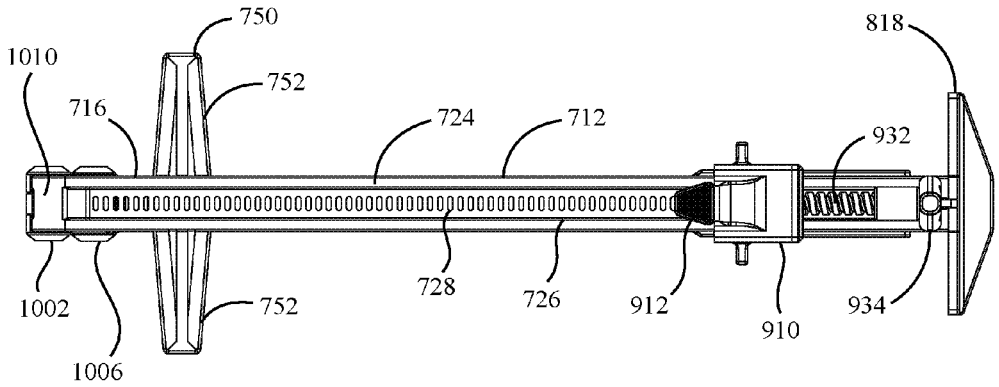
FIG. 11 is a top view of the innovative door holding device of FIG. 6 in accordance with an aspect of the innovation.
Figure 12:
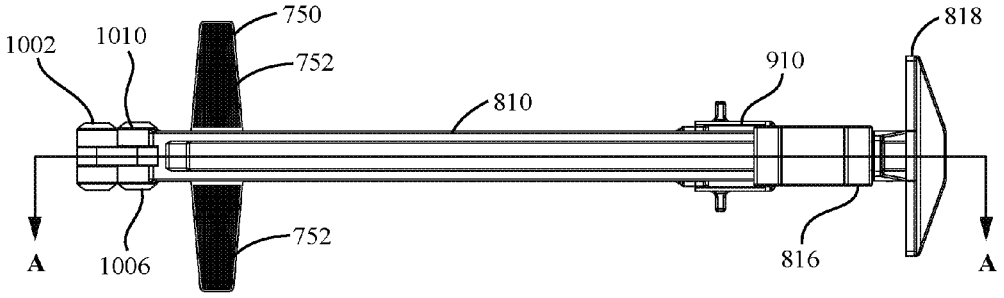
FIG. 12 is a bottom view of the innovative door holding device of FIG. 6 in accordance with an aspect of the innovation.
Figure 13:
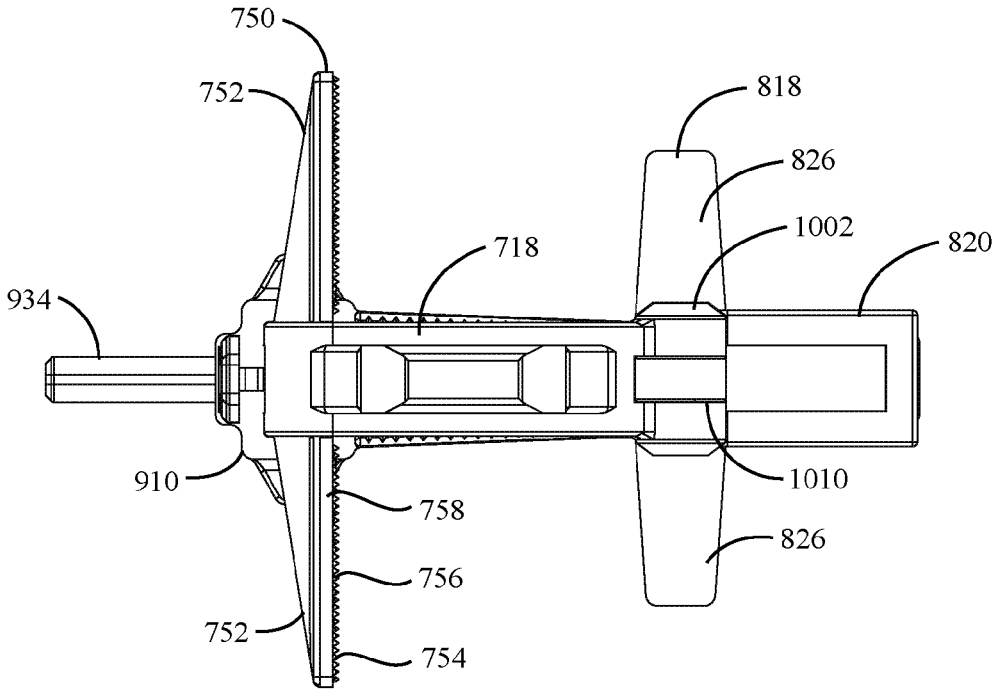
FIGS. 13 and 14 are opposite end end views of the innovative door holding device of FIG. 6 in accordance with an aspect of the innovation.
Figure 14:
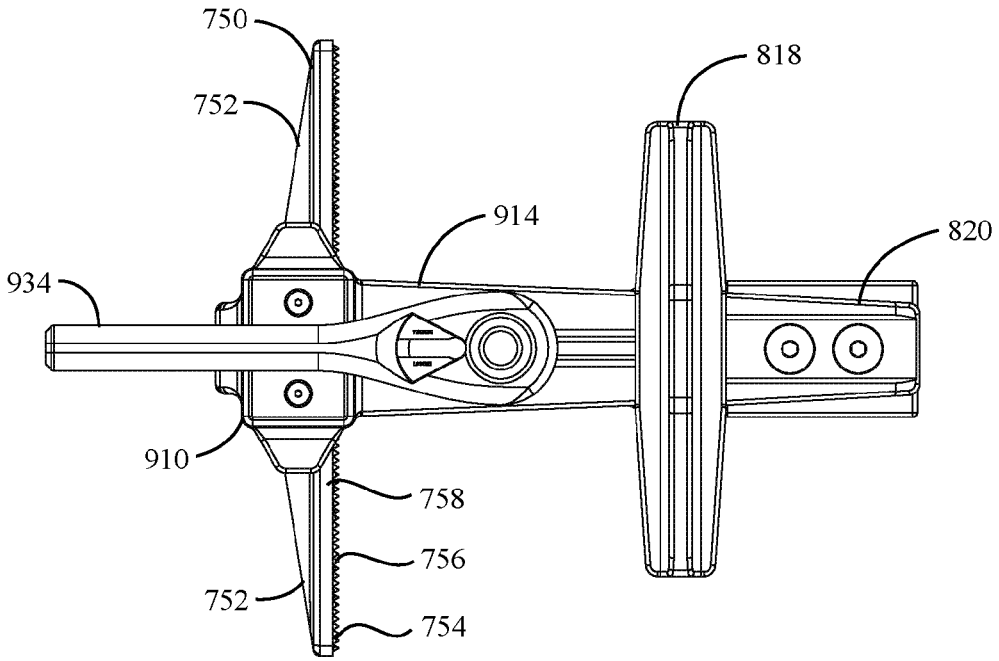
Figure 25:
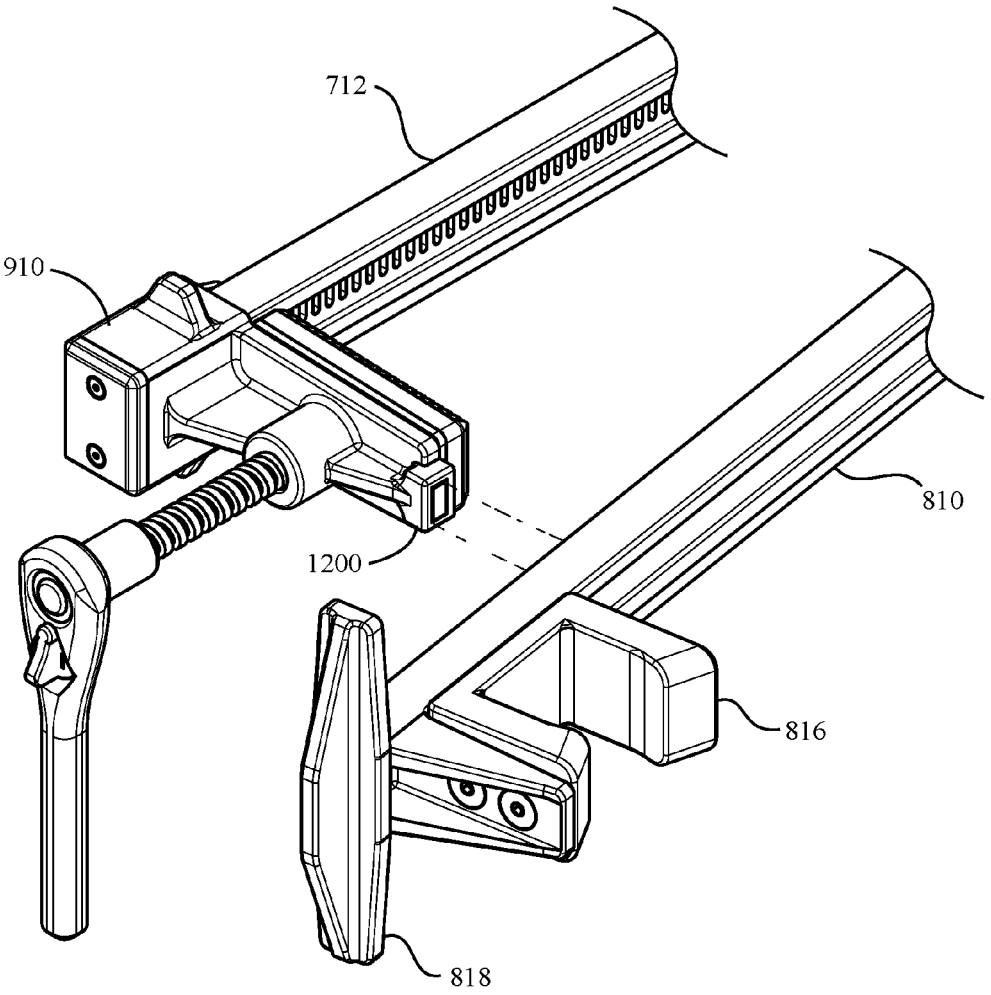
FIG. 25 is a close-up view of a clamping device in accordance with an aspect of the innovation.
Figure 26:
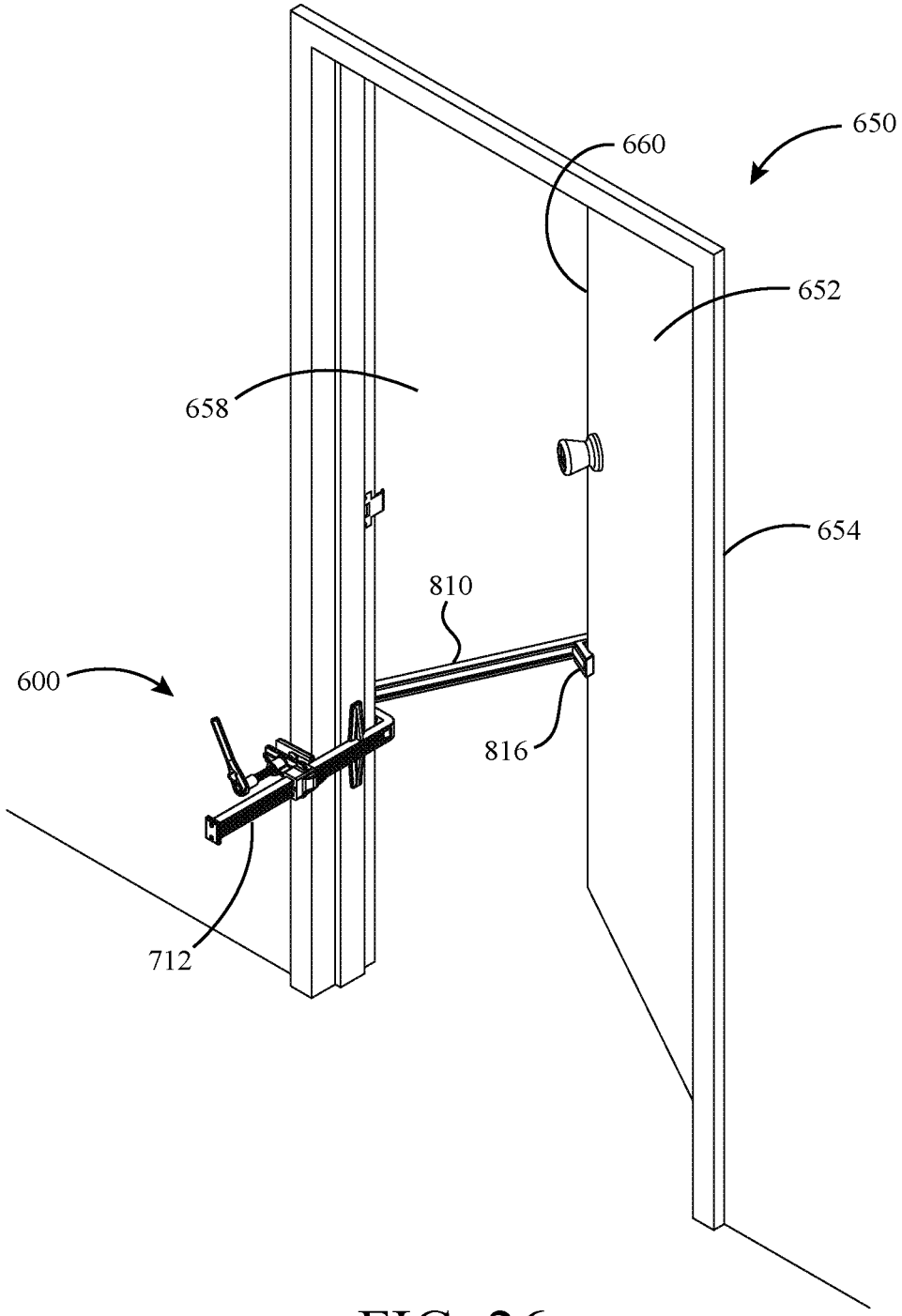
FIGS. 26-28 are perspective, plan, and top views of the door structure incorporating the innovative door holding device in accordance with an aspect of the innovation.

Referring to FIG. 25, the door holding device may further include a clamping device 1200 that holds the first and second arm assemblies 700, 800 in a transport/storage position (see FIGS. 6 and 10). The clamping device may be comprised of a hook, snap, clip, magnet, etc. that holds the first and second arm assemblies 700, 800 together. In one example embodiment, the clamping device 1200 may be a magnet and may be disposed on the extension part 914. Thus, the magnet contacts the second arm assembly 800 to secure it to the first arm assembly 700.

Referring to FIGS. 26-28, and 30, a method 2900 of attaching the door holding device 600 to the structure 650 will now be described. At 2902, the door holding device 600 is provided that includes the first arm assembly 700, the second arm assembly 800, and a movable clamping mechanism 900. At 2904, the first arm assembly 700 is placed against the door frame 654 such that the longitudinal part 712 and the support structure 750 contact an end face 662 of the door frame 654 and the stationary part 810 contacts one (first) side 664 of the door frame 654. At 2906, the release lever 912 is actuated so that the release lever is disengaged from the recesses 728 in the track 726. At 2908, the movable clamping mechanism 900 is move (slid) along the track 726 until at 2910, the movable pad 950 contacts an opposite (second) side 666 of the door frame 654. At 2912, the release lever 912 is released and reengages the recesses 728 on the track 726. At 2914, the handle 934 is activated in the tightening direction. At 2916, the movable pad 950 is tightened against the opposite side 666 of the door frame 654. At 2918, the movable pad 950 is compressed against the opposite side 666 of the door frame 654. At 2920, the stationary pad 730 is compressed against the one side 664 of the door frame 654. At 2922, the second arm assembly 800 is pivoted toward the vertical end 660 of the door 652. At 2924, the vertical end 660 of the door 652 is placed into the U-shaped holder 816.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A door holding device comprising:

a first arm assembly including a longitudinal part and a stationary part that form an L-shape, wherein the longitudinal part includes two channels disposed on two sides of the longitudinal part, respectively, and a track having recesses defined therein;

a second arm assembly;

a pivot device that pivotally connects the first arm assembly to the second arm assembly; and a movable clamping mechanism slidably attached to the first arm assembly that clamps to a structure to secure the door holding device to the structure, wherein the movable clamping mechanism includes a traveler that slides along the track, and wherein the traveler includes:

a quick release lever that engages one of the recesses to hold the traveler in a corresponding position along the track, and an extension part having a threaded aperture defined therein, and wherein the extension part extends in a direction from the traveler such that the stationary part and the extension part are substantially parallel to each other so as to form an approximate U-shape with the longitudinal part.

2. The door holding device of claim 1, wherein the movable clamping mechanism further includes a clamp tightening device that includes a threaded rod that extends through the threaded aperture defined in the extension part, a handle connected to one end of the threaded rod on one side of the extension part, and a movable pad having teeth defined therein and connected to an opposite end of the threaded rod on an opposite side of the extension part.

3. The door holding device of claim 2, wherein the stationary part includes a stationary pad having teeth defined therein and disposed on a face of the stationary part, and wherein when actuated, the clamp tightening device forces the movable pad against one side of the structure, which causes the stationary pad to compress against an opposite side of the structure, thereby causing the teeth from the stationary pad and the teeth from the movable pad to grip the one side and the opposite side of the structure, thereby securing the door holding device to the structure.

4. The door holding device of claim 1, wherein the second arm assembly includes a longitudinal part and a generally U-shaped holder disposed at a proximate end thereof that attaches to an end of a door to hold the door in a partially open position, relative to the structure.

5. The door holding device of claim 1, wherein the pivot device includes a first hinge having a first aperture defined therein and being attached to the first arm assembly, a second hinge having a second aperture defined therein and being attached to the second arm assembly, and a band that attaches the first hinge and the second hinge together.

6. The door holding device of claim 5, wherein the band includes a face having a first band aperture and a second band aperture defined therein, wherein the band extends between the first hinge and the second hinge such that the first band aperture aligns with the first aperture defined in the first hinge and the second band aperture aligns with the second aperture defined in the second hinge, and wherein a first fastener extends through the first aperture and through the first band aperture, and a second fastener extends through the second aperture and through the second band aperture to pivotally secure the first arm assembly to the second arm assembly.

7. A method of securing a door in a partially open configuration comprising:

providing a door holding device having a first arm assembly, a second arm assembly, and a movable clamping mechanism;

placing the first arm assembly against a door frame, whereby a longitudinal part of the first arm assembly contacts an end face of the door frame and a stationary part of the first arm assembly contacts one side of the door frame;

actuating a release lever located on the movable clamping mechanism so as to disengage the release lever from a corresponding recess of a plurality of recesses defined in a track in the longitudinal part such that the movable clamping mechanism is movable along the longitudinal part;

moving the movable clamping mechanism along the longitudinal part toward the door frame;

contacting an opposite side of the door frame with a movable pad on the movable clamping mechanism;

tightening the movable pad against the opposite side of the door frame;

compressing the movable pad against the opposite side of the door frame;

compressing a stationary pad on the stationary part against the one side of the door frame; and placing a vertical end of the door into a generally U-shaped holder of the second arm assembly.

8. The method of claim 7, wherein after contacting the opposite side of the door frame with the movable pad on the movable clamping mechanism, the method further comprising releasing the release lever such that the release lever reengages with a corresponding recess of the plurality of recesses defined in the track.

9. The method of claim 7, wherein prior to tightening the movable pad against the opposite side of the door frame, the method further comprising actuating a handle on the movable clamping mechanism in a tightening direction.

10. The method of claim 7, wherein prior to placing the vertical end of the door into the generally U-shaped holder, the method further comprising pivoting the second arm assembly toward the door.

11. A door holding system comprising:

a door holding device including:

an first arm assembly including a first longitudinal part and a stationary part that form an L-shape, wherein the first longitudinal part includes two channels disposed on two sides of the first longitudinal part, respectively, and a track having recesses defined therein;

a second arm assembly pivotally attached to the first arm assembly; and a movable clamping mechanism slidably attached to the first arm assembly that clamps to a structure to secure the door holding device to the structure, wherein the movable clamping mechanism includes a traveler that slides along the track, and wherein the traveler includes:

a quick release lever that engages one of the recesses to hold the traveler in a corresponding position along the track, and an extension part having a threaded aperture defined therein, and wherein the extension part extends in a direction from the traveler such that the stationary part and the extension part are substantially parallel to each other and form an approximate U-shape with the first longitudinal part; and an electronic wireless communicator disposed in or on the door holding device, wherein the wireless communicator provides electronic communication to and/or from an external electronic communicating system.

12. The door holding system of claim 11, wherein the movable clamping mechanism is slidably attached to the first longitudinal part.

13. The door holding system of claim 11, wherein the movable clamping mechanism further includes a clamp tightening device that includes a threaded rod that extends through the threaded aperture defined in the extension part, a handle connected to one end of the threaded rod on one side of the extension part, and a movable pad having teeth defined therein and connected to an opposite end of the threaded rod on an opposite side of the extension part.

14. The door holding system of claim 13, wherein the stationary part includes a stationary pad having teeth defined therein and disposed on a face of the stationary part, and wherein when actuated, the clamp tightening device forces the movable pad against one side of the structure, which causes the stationary pad to compress against an opposite side of the structure, thereby causing the teeth from the stationary pad and the teeth from the movable pad to grip the one side and the opposite side of the structure, thereby securing the door holding device to the structure.

15. The door holding system of claim 14, wherein the second arm assembly includes a second longitudinal part having a generally U-shaped holder disposed at a proximate end thereof that attaches to an end of a door to hold the door in a partially open position relative to the structure.

16. The door holding system of claim 15, wherein the door holding device further comprises a pivot device that pivotally connects the stationary part to the second longitudinal part, the pivot device including a first hinge attached to a distal end of the stationary part, a second hinge attached to a distal end of the second longitudinal part, and a band that attaches the first hinge and the second hinge together.

* * * * *